US006156471A

United States Patent [19]

Kobori et al.

[11] Patent Number: 6,156,471

[45] Date of Patent: Dec. 5, 2000

[54] TONER AND IMAGE FORMING METHOD

[75] Inventors: Takakuni Kobori, Susono; Hirohide Tanikawa; Masami Fujimoto, both of Shizuoka-ken; Hiroyuki Fujikawa, Yokohama, all of Japan

[73] Assignee: Canon Kabushiki Kaisha, Tokyo, Japan

[21] Appl. No.: 09/487,703

[22] Filed: Jan. 19, 2000

[30] Foreign Application Priority Data

Jan. 21, 1999 [JP] Japan ..... 11-012569

[51] Int. Cl.[7] ..... G03G 9/097

[52] U.S. Cl. ..... 430/110; 430/111; 430/120

[58] Field of Search ..... 430/110, 111, 430/120

[56] References Cited

U.S. PATENT DOCUMENTS

| | | | |
|---|---|---|---|
| 2,297,691 | 10/1942 | Carlson | 430/3 |
| 3,666,363 | 5/1972 | Tanaka et al. | 430/55 |
| 4,071,361 | 1/1978 | Marushima | 430/54 |
| 5,244,764 | 9/1993 | Uno et al. | 430/110 |
| 5,612,159 | 3/1997 | Sato et al. | 430/110 |
| 5,712,073 | 1/1998 | Katada et al. | 430/110 |
| 5,811,214 | 1/1999 | Osterhoudt et al. | 430/111 |
| 5,858,597 | 1/1999 | Mizoh et al. | 430/110 |

FOREIGN PATENT DOCUMENTS

| | | |
|---|---|---|
| 0223594 | 5/1987 | European Pat. Off. . |
| 58-066951 | 4/1983 | Japan . |
| 59-168458 | 9/1984 | Japan . |
| 59-168459 | 9/1984 | Japan . |
| 59-168460 | 9/1984 | Japan . |
| 59-170847 | 9/1984 | Japan . |
| 61-236558 | 10/1986 | Japan . |
| 61-236560 | 10/1986 | Japan . |
| 62-061070 | 3/1987 | Japan . |
| 62-119550 | 5/1987 | Japan . |
| 1-204068 | 8/1989 | Japan . |
| 7-060651 | 3/1995 | Japan . |
| 8-082949 | 3/1996 | Japan . |
| 10-183104 | 7/1998 | Japan . |

*Primary Examiner*—Roland Martin
*Attorney, Agent, or Firm*—Fitzpatrick, Cella, Harper & Scinto

[57] ABSTRACT

An electrophotographic toner showing good cleanability and is suitable for use in developing an electrostatic latent image formed on an amorphous-silicon photosensitive member is provided. The toner includes toner particles each comprising a binder resin and a colorant, and inorganic fine powder A. The inorganic fine powder A contains 88.0–97.0 wt. % of a rare earth compound comprising a rare earth oxide. The rare earth compound contains 40.0–65.0 wt. % of Ce (calculated as $CeO_2$), 25.0–45.0 wt. % of La (calculated as $La_2O_3$), 1.0–10.0 wt. % of Nd (calculated as $Nd_2O_3$) and 1.0–10.0 wt. % of Pr (calculated as $Pr_6O_{11}$). The rare earth compound contains further a fluorinated rare earth compound in such an amount as to provide the inorganic fine powder A with a fluorine content of 2.0–11.0 wt. %.

35 Claims, 2 Drawing Sheets

TONER AND IMAGE FORMING METHOD

FIELD OF THE INVENTION AND RELATED ART

The present invention relates to a toner for use in an image forming or recording method, such as electrophotography and toner jetting, and an image forming method using the toner.

Hitherto, a large number of electrophoto-graphic processes have been known, inclusive of those disclosed in U.S. Pat. Nos. 2,297,691; 3,666,363; and 4,071,361. In these processes, in general, an electrical or electrostatic latent image is formed on a photosensitive member comprising a photoconductive material by various means, then the latent image is developed with a toner, and the resultant toner image is, after being transferred onto a recording material (or transfer material) such as paper etc., via or without via an intermediate transfer member, as desired, fixed by heating, pressing, or heating and pressing, or with solvent vapor to obtain a copy or print carrying a fixed toner image.

Heretofore, there has been generally adopted an analog latent image formation scheme wherein an original image is exposed to light and a photosensitive member is exposed to the reflected light to form a latent image thereon. In recent years, however, a digital latent image formation scheme wherein reflected light from an original is converted into electric signals, and based on the electric signals after some processing, modulated illumination light from laser, LED, etc., is caused to directly illuminate a photosensitive member to form a latent image thereon, and electrophotographic systems and electrostatic recording systems adopting such a digital scheme have been commercialized.

In most electrophotographic systems using digital image signals, a light-emitting member, such as a semiconductor laser, is turned on and off based on the image signals, and light from the member is projected onto the photosensitive member. In the case of character image formation, the print percentage (the percentage of printed or recorded character image area on a recording sheet) is generally at most 3%, so that the so-called reversal development scheme of selectively exposing the character portions is advantageous in view of the life of the light-emitting member. The latent image is formed by an assembly of constant-potential dots (pixel units), and dot image densities are varied for expressing a solid image portion, a halftone image portion and a light image portion. In such a digital scheme compared with the analog scheme, however, particularly a developed halftone image is more noticeably affected by "image flow" which is a phenomenon of image blurring due to flow of latent image charge liable to be caused by attachment of low-resistivity soiling substance onto the photosensitive member, because of the latent image-forming mechanism.

On the other hand, in the case of forming digital reversal latent images by using semiconductor lasers, photosensitive members having a spectral sensitivity in an infrared region around 800 nm have been used.

As a photosensitive member having a spectral sensitivity in the region, an amorphous silicon (hereinafter sometimes abbreviated as "a-Si") photosensitive member is known. The a-Si photosensitive member is excellent in durability, such as heat resistance and abrasion resistance and has a high sensitivity over a wide region, so that various lasers can be used in combination therewith and it allows higher-speed and multi-function copying machines, etc. Although an a-Si photosensitive member has the above-mentioned advantages, the a-Si photosensitive member also involves a practical disadvantage that it is generally difficult to provide a thick a-Si layer in view of the productivity and production cost, therefore a practical level of a-Si photosensitive member having a relatively thin a-Si layer cannot provide a high charged potential and it is necessary to use a toner capable of development at a low potential contrast. It is also important to provide the toner with an increased charge and control the charge as uniformly as possible. Particularly, it is important to prevent the lowering in toner charge and toner flowability in a high temperature/high humidity environment.

Further, while an a-Si photosensitive member has a high surface hardness and a high durability, the hardness also leads to a problem that the photosensitive surface is difficult to abrade. In an electrophotographic process, the developed toner image on the photosensitive member is transferred to a a transfer material, such as paper, and the residual toner remaining on the photosensitive member is removed by a cleaning member. However, the removal of the residual toner by such a cleaning member is not necessarily complete. Such a portion of residual toner remaining after the cleaning is ordinarily removed together with a superficial portion of the photosensitive member by friction with the toner in the subsequent development and transfer process, thus leaving substantially no problem. However, as an a-Si photosensitive member has a high hardness and cannot be easily abraded, so that the remaining residual toner is difficult to completely remove and is liable to cause toner melt-sticking onto the photosensitive member.

Further, on the photosensitive member surface, impurities or soiling substances, such as paper dust, ozone adduct and exudates from the transfer rubber roller attached to the photosensitive member via the transfer material occurring during the electrophotographic process, are present. These soiling substances are also removed together with an abraded superficial portion of the photosensitive member similarly as the residual toner, thus leaving substantially no problem. However, in the case of using an a-Si photosensitive member, those soiling substances are difficult to completely remove, thus being liable to cause image defects, such as image flow.

For preventing the image flow, it has been proposed to install a drum heater for temperature control within the photosensitive member to raise the photosensitive member surface temperature and lower the relative humidity, thereby suppressing moisture attachment onto the photosensitive member surface. However, the photosensitive member surface temperature cannot be freely increased in view of temperature increase in the image forming apparatus and increase of power consumption. Accordingly, the solution of the above problems by improvement of the toner is desired.

As the cleaning member, a cleaning blade and a cleaning roller are known. These cleaning members are used singly or in combination. According to the cleaning blade scheme, an elastic blade is caused to contact the photosensitive member and physically scrape off the remaining matter on the photosensitive member. Ordinarily, the residual toner is present at a position of contact between the blade and the photosensitive member, and the residual toner functions as a lubricant between the cleaning blade and the photosensitive member, thus contributing to satisfactory cleaning. When such residual toner is abruptly decreased, the lubricity becomes locally inferior, the cleaning blade is liable to be turned over toward the rotation direction of the photosensitive member or vibrate, thus failing to effect the cleaning of the residual toner on the photosensitive member. Accordingly, it has been practiced to disposed a cleaning roller at a position upstream of the cleaning blade in the rotation direction of the photosensitive member so as to effect a stable toner supply to the cleaning blade, thereby scraping off the remaining matter on the photosensitive member by friction and applying the toner onto the photosensitive member. In this case, however, in the cleaning system including the cleaning roller, the agglomerates of toner or paper dust are liable to occur and the agglomerates are put between the cleaner blade and the photosensitive member, thus causing slipping-by of the toner.

For solving the above problems, various proposals have been made to incorporate inorganic fine powder as an abrasive or a lubricant in the toner. For example, Japanese Laid-Open Patent Application (JP-A) 58-66951, JP-A 59-168458, JP-A 59-168459, JP-A 59-168460 and JP-A 59-170847 have disclosed the addition of electroconductive zinc oxide and tin oxide. However, it is difficult to obtain a stable image density in high-speed digital development or low-potential development by using such a toner. Further, many proposals have been made to use cerium oxide particles as abrasive particles. For example, JP-A 62-119550 has disclosed the addition of cerium oxide together with hydrophobic silica in a negatively chargeable toner, but this either does not allow a stable charging in a positively chargeable toner or digital high-speed development or digital reversal development. Further, JP-A 61-236560 discloses addition of rare earth compounds comprising principally cerium oxide. The compounds do not have uniform hardness, thus ununiformly abrading the photosensitive member and resulting in a difference in friction coefficient between an abraded portion and a yet-unabraded portion of the photosensitive member with the cleaning blade, which lead to turn-over of the blade and toner slippage by the blade. Further, JP-A 1-204068 and JP-A 8-82949 have disclosed the inclusion of cerium fluoride or fluorine-containing cerium oxide particles to exhibit advantageous results, but this alone leaves a difficulty in providing a uniform hardness. Further, in the case of using such cerium oxide particles, difficulties such as unstable image densities and fog, are liable to occur due to the occurrence of charge imbalance in the toner. Thus, a toner having a good balance among abrasion characteristic, lubricity, cleanability and developing performance, is still desired.

SUMMARY OF THE INVENTION

A generic object of the present invention is to solve the above-mentioned problems of the prior art.

A more specific object of the present invention is to provide a toner having excellent developing performances to result in images with stable densities and little fog within various environments including high temperature/high humidity environment and low temperature/low humidity environment.

Another object of the present invention is to provide a toner free from toner melt-sticking or image flow.

A further object of the present invention is to provide an image forming method using an a-Si photosensitive member and yet capable of good developing performances.

A further object of the present invention is to provide an image forming method free from image flow without excessively raising the photosensitive member surface temperature by means of a drum heater.

A further object of the present invention is to provide an image forming method using a cleaning system including a cleaning blade, a cleaning roller or a combination of these and capable of preventing cleaning failure, such as toner slipping by the blade, blade turnover or toner leakage from blade edges.

A further object of the present invention is to provide an image forming method using a conveying rubber roller as a conveyer mean s for a transfer material and yet capable of obviating attachment of soiling substances leading to image flow.

According to the present invention, there is provided a toner, comprising: toner particles each comprising a binder resin and a colorant, and inorganic fine powder A, wherein the inorganic fine powder A contains 88.0–97.0 wt. % of a rare earth compound comprising a rare earth oxide, the rare earth compound contains 40.0–65.0 wt. % of Ce (calculated as $CeO_2$), 25.0–45.0 wt. % of La (calculated as $La_2O_3$), 1.0–10.0 wt. % of Nd (calculated as $Nd_2O_3$) and 1.0–10.0 wt. % of Pr (calculated as $Pr_6O_{11}$), and the rare earth compound contains a fluorinated rare earth compound in such an amount as to provide the inorganic fine powder A with a fluorine content of 2.0–11.0 wt. %.

According to the present invention, there is further provided an image forming method, comprising:

a charging step of charging an image-bearing member, an image forming step of forming an electrostatic image on the charged image-bearing member, a developing step of developing the electrostatic image with the above-mentioned toner to form a toner image on the image-bearing member, a transfer step of transferring the toner image onto a recording material via or without via an intermediate transfer member, a fixing step of heat-fixing the toner image onto the recording material, and a cleaning step of cleaning a surface of the image bearing member after transfer of the toner image.

These and other objects, features and advantages of the present invention will become more apparent upon a consideration of the following description of the preferred embodiments of the present invention taken in conjunction with the accompanying drawings.

DETAILED DESCRIPTION OF THE INVENTION

Figure 1:
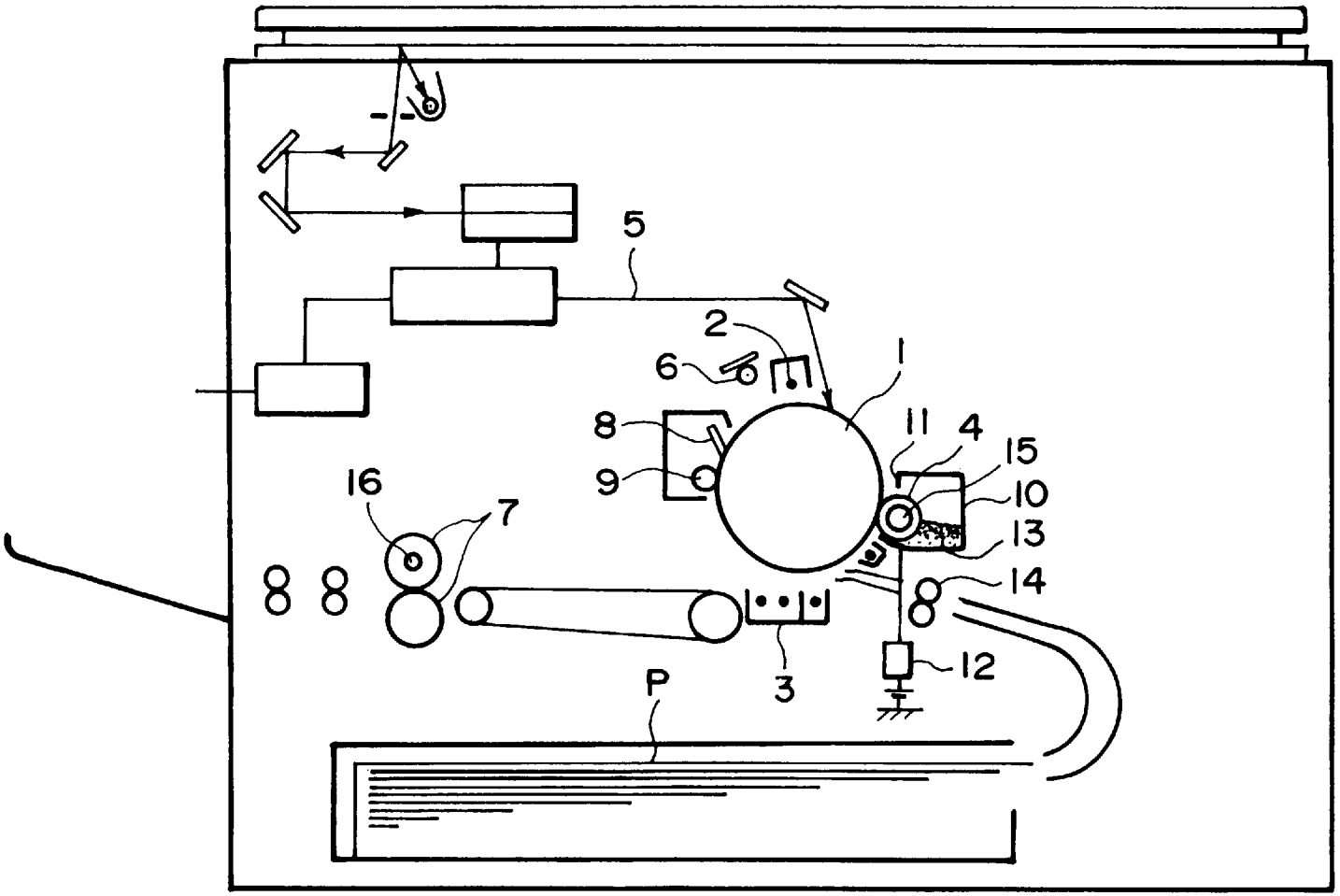
FIG. 1 is a schematic illustration of an image forming apparatus for practicing the image forming method according to the invention.

The toner according to the present invention comprises toner particles each comprising a binder resin and a colorant, and inorganic fine powder A. Further, the inorganic fine powder A contains 88.0–97.0 wt. %, preferably 89.0–96.0 wt. %, more preferably 90.0–95.0 wt. %, of a rare earth compound comprising a rare earth oxide. If the content of the rare earth compound in the inorganic fine powder A is below 88.0 wt. %, the abrasion effect thereof is liable to be unstable, and if the content exceeds 97 wt. %, the lubricity can be adversely affected, so that the stability of cleaning and the stability of abrasion effect can be impaired.

The rare earth compound is characterized by containing 40.0–65.0 wt. %, preferably 45.0–65.0 wt. %, further preferably 50.0–63.0 wt.%, of Ce (calculated as its oxide, i.e., $CeO_2$), so as to provide a good balance between the abrasion effect and lubricating effect, thereby exhibiting a stable developing performance. If the Ce content exceeds 65.0 wt. %, the photosensitive member is liable to be excessively abraded to exhibit a shorter life and irregular abrasion, whereby the uniformity of surface potential can be lost to result in image density irregularities. Further, the toner can be excessively charged to result in an image density lowering. On the other hand, if the Ce content is below 40.0 wt. %, the lubricity becomes inferior to cause vibration or turn-over of the cleaning blade in some cases. Further, the toner chargeability can be fluctuated to result in unstable image densities.

The rare earth compound contains 25.0–45.0 wt. %, preferably 27.0–43.0 wt. %, further preferably 30.0–40.0 wt. %, of La (calculated as its oxide, i.e., $La_2O_3$) so as to stabilize the flowability of the toner. The La content is particularly effective for stabilizing the flowability of the waste toner in the cleaner. If the La content is below 25.0 wt. %, the toner flowability in the cleaner becomes unstable, whereby the toner can be leaked out of both edges of the cleaner blade to cause the toner melt-sticking onto edges of the photosensitive member. If the La content exceeds 45.0 wt. %, the flowability becomes unstable to result in poor movement of the waste toner in the cleaner, thus causing discharge failure or toner clogging. Further, the toner can clog at the blade edge, thus causing floating of the cleaning blade leading to cleaning failure.

The rare earth compound contains 1.0–10.0 wt. %, preferably 1.0–8.0 wt. %, further preferably 2.0–5.0 wt. %, of Nd (calculated as its oxide, i.e., $Nd_2O_3$) so as to stabilize the residence of the inorganic fine powder A and cleaning performance, thus preventing cleaning failure. Further, as the residence of the inorganic fine powder A is stabilized, it becomes possible to more effectively prevent the melt-sticking and image flow. Outside the prescribed range, the stable presence of the inorganic fine powder A at the cleaner blade edge is liable to be failed, so that agglomerates generated in the cleaner are liable to be put between the blade and the photosensitive member, thus causing the slipping-by of the toner. Further, the blade edge can be exposed to result in an abrupt change in friction coefficient, leading to vibration of the blade or cleaning failure due to toner slipping-by. Further, in case where the Nd content exceeds 10.0 wt. %, the amount of the inorganic fine powder transferred along with the toner particles can be increased to reduce the supply to the cleaning blade. On the other hand, if the Nd content is below 1.0 wt. %, the inorganic fine powder is liable to move together with the waste toner, so that the residence at the blade edge can be unstable.

The rare earth compound contains 1.0–10.0 wt. %, preferably 2.0–9.0 wt. %, further preferably 3.0–8.0 wt. %, of Pr (calculated as its oxide, i.e., $Pr_6O_{11}$) so as to stabilizing the charging stability of the toner. If the Pr content exceeds 10.0 wt. %, the inorganic fine powder A is liable to be excessively charged, thus exhibiting an electrostatic attachment force to cause toner melt-sticking onto the photosensitive member. If the Pr content is below 1.0 wt. %, the inorganic fine powder is liable to adsorb fine toner particles to form fogging particles, thus resulting in spotty fog.

The inorganic fine powder A is also characterized by comprising a fluorine-containing rare earth compound so as to provide a fluorine content of 2.0–11.0 wt. %, preferably 3.0–10.0 wt. %, more preferably 4.0–9.0 wt. %, based on the inorganic fine powder A, thereby stabilizing the toner chargeability and stable continuous developing performance. Particularly, it becomes possible to provide a positively chargeable toner with a high chargeability. In case where the fluorine content exceeds 11.0 wt. %, if the inorganic fine powder A is used to form a negatively chargeable toner, the chargeability balance is liable to be disordered, leading to an image density lowering or occurrence of fog. Further, the abrasion characteristic can be insufficient. In case where the fluorine content is below 2.0 wt. %, if the inorganic fine powder A is used to form a positively chargeable toner, the chargeability balance is liable to be disordered, leading to an image density lowering and occurrence of fog. Further, the rare earth compound content can be increased thereby to provide an increased abrasion characteristic leading to a shorter life of the photosensitive member.

If is preferred that the inorganic fine powder A has been obtained by first converting bastnaesite into rare earth oxide (through steps of pulverization, dissolution in sulfuric acid, conversion into carbonate and calcination) and partially fluorinating the rare earth oxide. An ordinary bastnaesite-based abrasive has been obtained through a process wherein crude bastnaesite is subjected to dressing as by magnetic separation and flotation to form dressed bastnaesite, followed by pulverization, drying, calcination, further pulverization and classification for particle size adjustment to provide an abrasive. The starting or natural bastnaesite already contains fluorine in the form of R—O—F (wherein R denotes a rare earth element; O, oxygen and F, fluorine). However, by first converting bastnaesite into rare earth oxide and then fluorinatingi the rare earth oxide with hydrofluoric acid, fluorine can be more effectively introduced inside the bastnaesite particles in the form of R—F (R, rare earth element; F, fluorine), thus providing an appropriate degree of abrasive characteristic. In the inorganic fine powder A, the rare earth elements can be equally fluorinated but lanthanum exhibiting a stronger basicity among these can be preferentially fluorinated to provide the toner with a good charge stability, thereby obviating a density decrease even in a long period of use.

If is preferred that the uranium content and the thrium content in the inorganic fine powder A are respectively less than 100 ppm (by weight herein), more preferably at most 10 ppm, particularly preferably at most 1 ppm, in terms of their elementary content and not oxide content. Larger contents of these can adversely affect the charge stability, and particularly when used to form a positively chargeable toner, the chargeability balance thereof is liable to be disordered to result in a lower density and fog.

The inorganic fine powder A may preferably have a volume-average particle size (Dv) of 0.1–4.0 $\mu$m, more preferably 0.2–2.0 $\mu$m, and a BET specific surface area according to nitrogen adsorption ($S_{BET}$) of 0.5–15.0 $m^2/g$, more preferably 1.0–10.0 $m^2/g$. If the volume-average particle size is below 0.1 $\mu$m, the inorganic fine powder A is liable to have an excessively high agglomeratability, thus adversely affecting the toner flowability. On the other hand, if the volume-average particle size exceeds 4.0 $\mu$m the abrasive effect can be insufficient. If the BET specific surface area exceeds 15.0 $m^2$, the developing performance is liable to be lowered particularly in a high humidity environment. Further, if the BET specific surface area is below 0.5 $g/m^2$, the abrasive effect is liable to be insufficient.

The toner according to the present invention may preferably contain the inorganic fine powder A in a proportion of 0.1–10.0 wt. %, more preferably 0.1–7.0 wt. %. If the content is below 0.1 wt. %, the addition effect thereof is liable to be insufficient. If the content exceeds 10.0 wt. %, the localization and separation of the inorganic fine powder A in the toner are liable to occur, whereby the photosensitive member can be excessively abraded in a long period of use to result in a fluctuation in frictional coefficient of the photosensitive member surface and cleaning failure.

The inorganic fine powder A sufficiently exhibits its effect particularly when it is used to provide a positively chargeable toner. Hitherto, strontium titanate or ordinary cerium oxide has been frequently used as an abrasive. However, these abrasives are, when used to form a positively chargeable toner, liable to cause an insufficient charge or an ununiform charge. Most toner binder resins are rather negatively chargeable, and in order to provide a positively chargeable toner, a positive charge control agent is dispersed in such a binder resin. Accordingly, it is difficult to keep a good chargeability balance than in the case of a negatively chargeable toner. However, by using the inorganic fine powder A of the present invention, it is possible to keep a uniform charge of a positively chargeable toner without causing a charge imbalance.

The image forming method according to the present invention is principally characterized by use of the above-mentioned toner of the present invention and its effect is particularly well exhibited when an a-Si photosensitive member is used therein. More specifically, soiling substances on such an a-Si photosensitive member surface having a high hardness can be uniformly abraded and removed without causing toner charging failure, so that a stable image density is attained and fog is reduced even at a low potential development using such an a-Si photosensitive member.

The performance of the image forming method is well developed when the photosensitive member surface temperature is set to a slightly elevated temperature of at most 45° C., more preferably at most 42° C. In case where the photosensitive member surface temperature is lowered, moisture attachment onto the photosensitive member surface is increased in a high humidity environment and image flow is liable to be caused due to a combination of the attached moisture and attached ozone adduct, but in the image forming method according to the present invention, the attached ozone adduct is effectively removed by abrasion with the toner of the present invention so that the image flow is suppressed. Further, it is even possible to effectively operate the image forming method without using a drum heater.

Further, the performance of the image forming method according to the present invention is well exhibited in case where a cleaning blade, a cleaning roller or a combination of these is used as the cleaning member. The inorganic fine powder A in the toner of the present invention is present on the cleaning roller to abrade the photosensitive member in an appropriate degree, or/and is present at the cleaner blade edge to increase the lubricity between blade-photosensitive member, thus preventing the turn-over or vibration of the cleaning blade, and further functions as an abrasive to remove the melt-stuck toner on the photosensitive member.

The performance of the image forming method according to the present invention is further well exhibited when a cleaning roller enclosing a magnetic field generating means is used. In this case, the toner attachment onto the cleaning roller is enhanced by the magnetic force, thus being liable to generate agglomerates due to longer period of stirring on the roller. In an ordinary case, the agglomerates are liable to be put between the cleaning blade and the photosensitive member, thereby causing the slipping-by of the toner. The inorganic fine powder A of the present invention however is present at the cleaning blade edge to prevent the invasion of the agglomerates.

Further, the performance of the image forming method according to the present invention is well exhibited in case where an elastic roller is used as a conveyer member for a recording material (transfer material). For example, the problem of soiling substance from the elastic roller soiling the photosensitive member surface to cause image defects can be solved by effective removal of the soiling substance from the photosensitive ember surface by use of the toner according to the present invention.

As described above, compared with a conventional abrasive of ordinary cerium oxide or strontium titanate, the inorganic fine powder A exhibits a good balance of abrasiveness and lubricity, thus assisting stable cleaning of the photosensitive member by a cleaning member to reduce the occurrence of cleaning failure.

The properties described herein for characterizing the inorganic fine powder A are based on values measured in the following manner.

(1) Content of Rare Earth Compound

The content may be measured according to the oxalate weight method. More specifically, for example, ca. 0.5 g of an inorganic fine powder sample is lightly stirred with 15 ml of $HClO_4$ and 1 ml of $H_2O_2$ and subjected to heating and decomposition on a hot plate to be condensed to ca. 5 ml. Further, ca. 50 ml of pure water is added thereto, and the mixture is boiled and then filtrated. The filtered precipitate is further washed with warm water so as to provide a totally ca. 250 ml of filtrate. Under heating of the 250 ml of filtrate, 50 g of oxalic acid is added and completely dissolved under stirring, followed by standing for cooling, adjustment to pH 1.3–1.5 with $NH_4OH$ or HCl, filtration and washing. The resultant precipitate is placed in a porcelain crucible, dried at 140° C. for ca. 1 hour and ignited into ash at 1000° C. for ca. 1 hour to obtain a rare earth compound, which is then weighed to determine a content relative to the weight of the inorganic fine powder sample.

(2) Contents of Rare Earth Elements in Rare Earth Compound

The contents of Ce, La, Nd and Pr in the rare earth compound obtained in (1) above are measured according to ICP (inductively coupled plasma) emission spectroscopy according to JIS K0116 "Emission Spectroscopy General Rules" and calculated based on the respective oxide forms. U and Th are measured simultaneously and the contents (wt. ppm) thereof are determined based on elementary bases.

(3) Fluorine Content in Inorganic Fine Powder

Ca. 0.5 g of an inorganic fine powder sample is accurately weighed, and 5 ml of 50 wt. %-NaOH aqueous solution and 5 ml of pure water were added thereto to dissolve the sample under heating. After cooling, pure water is added thereto up to a total volume of 100 ml. Of the 100 ml, 50 ml is taken in a 100 ml-volumetric flask, and 50 ml of a buffer solution (formed by dissolving 100 ml of acetic acid, 116 g of sodium chloride and 2 g of sodium nitrate in 1.5 liter of distilled water) is added thereto to form a constant volume aqueous solution, of which the fluorine content is measured by an ion meter.

(4) Volume Average Particle Size of Inorganic Fine Powder

An inorganic fine powder sample is subjected to measurement of a particle size distribution by a laser diffraction-type particle size meter (according to the micro-track method), and a particle size (diameter) giving an accumulative volume percentage of 50% is taken as a volume-average particle size of the sample.

(5) BET Specific Surface Area ($S_{BET}$) of Inorganic Fine Powder

A sample inorganic fine powder is placed in a full-automatic gas adsorption meter ("Autosorb 1", mfd. by Yuasa Ionics K.K.) and, after pretreatment at 50° C. for 6 hours for degassing, subjected to a specific surface area measurement according to the BET multi-point method using nitrogen as an adsorbate gas.

The toner according to the present invention may preferably further contain inorganic fine powder B exhibiting a pH (as measured in a dispersion at a concentration of 4 g/100 cc) of at least 7, preferably 7.5–12.0, particularly preferably 8.0–11.0, so as to provide a good toner flowability especially in a low humidity environment. Thus, by including such inorganic fine powder B, an excessive charge of toner can be leaked out to maintain a constant toner charge and reduce electrostatic agglomeration, thus providing a remarkably improved flowability. At a pH below 7, it becomes difficult to effect the leakage of excessive triboelectric charge and uniformization of the charge via moisture. At a pH above 12.0, the charge leakage can be excessive. More specifically, the pH of the inorganic fine powder B is related with a polar compound or a functional group at the surface of the powder, and a pH value of 7 or higher is given when the amount reaches or exceeds a certain level. The polar substance or functional group giving an increased pH value critically functions to effect the charge relaxation. Such polar substance may be given by a substituent or reaction residue group of a treating agent for giving the inorganic fine powder B. For example, ammonia or amines may exhibit such function in case where silazanes or silylamines are used. Further, in the case of using an aminosilane or amino-modified silicone oil, aminoalkyl groups on the silicon atoms may exhibit such functions.

More specifically, by providing the inorganic fine powder B with a pH of at least 7, it becomes possible to retain moisture adsorption points, charge leakage points and charge migration points at effective densities. Further, it is possible to enlarge the ranges of densities of such moisture adsorption points, charge leakage points and charge migration points by increasing the BET specific surface area of the inorganic fine powder B. Preferred ranges of BET specific surface areas of the inorganic fine powder B will be described later.

In the case of using the toner according to the present invention in an image forming apparatus using an organic photosensitive member, the toner according to the present invention may preferably contain inorganic fine powder C treated with silicone oil. The inorganic fine powder C has a function of providing an increased lubricity and a mild abrasion effect, thus obviating excessive abrasion and damage on the organic photosensitive member having a low hardness and allowing a satisfactory cleaning performance. Further, by including such inorganic fine powder C, the photosensitive member can be more uniformly abraded, thus ensuring a good transfer performance.

The inorganic fine powders B and C may comprise oxides, double oxides, metal oxides, metals, silicon compounds, carbon, carbon compounds, fullerenes, boron compounds, carbides, nitrides, silicates and ceramics. Metal oxides are preferred. Among metal oxides, silica, alumina, titania and zirconia are particularly preferred. Further, silica is especially preferred so as to allow an appropriate degree of charge leakage and stable charge relaxation via moisture.

Silica used for constituting the inorganic fine powders B and C may preferably comprise dry-process silica as produced by vapor-phase oxidation (e.g., pyrolytic oxidation within oxyhydrogen flame) of silicon halides, or wet-process silica as produced by decomposition of silicon compounds, such as sodium silicate, alkaline earth metal silicates and other silicates with acids, ammonia, salts, alkaline salts, etc. Amorphous silica is preferred. It is also possible to use fine powder of double oxides of silicon and another metal by using a metal halide, such as aluminum chloride, titanium chloride, germanium chloride, tin chloride, zirconium chloride, and lead chloride, together with silicon halides. Among the above, dry-process silica without having excessive inner surface area is preferred to allow an appropriate degree of moisture adsorption.

Titania used for providing the inorganic fine powders B and C may be formed through the sulfuric acid process, the chlorine process, or low-temperature oxidation (thermal decomposition or hydrolysis) of, e.g., titanium alkoxides, titanium halides, and titanium acetylacetonate. The titania may have a crystal form of anatase, rutile or mixture crystal of these or may be amorphous. It is particularly preferred to use amorphous titania formed by low-temperature oxidation, or anatase-form or mixture crystal-form titania formed through the chlorine process or the sulfuric acid process.

Alumina used for providing the inorganic fine powders B and C may be formed through the Bayer process, the improved Bayer process, the ethylene chlorohydrin process, the water spark discharge process, the organic aluminum hydrolysis process, the aluminum alum pyrolysis process, the ammonium aluminum carbonate pyrolysis process, and the aluminum chloride flame decomposition process. Alumina of any crystal form, inclusive of $\alpha$, $\beta$, $\gamma$, $\xi$, $\eta$, $\sigma$, $\kappa$, $\rho$ or mixture of these and amorphous alumina, may be used. Among these, $\alpha$, $\gamma$, $\delta$, $\theta$ or mixture crystal form alumina and amorphous alumina may be preferred. It is particularly preferred to use $\gamma$- or $\delta$-form alumina produced through the pyrolysis process or the flame decomposition process.

The inorganic fine powder B exhibiting a pH of at least 7 may be formed by treating such inorganic fine powder of silica, etc., with a nitrogen-containing compound reactive with or physically adsorbed by the inorganic fine powder, such as silazanes, silane compounds having a nitrogen atom directly bonded to silicon atoms, silane compounds having a nitrogen-containing substituent and silicone oils having a nitrogen-containing substituent. In case where a sufficient hydrophobicity is not attained by treatment with such a treating agent, the inorganic fine powder may also be treated with a silane compound or silicone oil. For example, in order to provide a further increased hydrophobicity, other organic silicon compounds, organic titanium compounds or organic aluminum compounds may be used in combination for the treatment. Among these, it is preferred to use a silane compound, silicone oil or silicone varnish. Several species of treating agents may be used in combination.

The inorganic fine powder C may also be treated with another organic treating agent in addition to silicone oil. Examples of such another organic treating agent may include organic silicon compounds, organic titanium compounds and organic aluminum compounds capable of reacting with or physically adsorbed by the inorganic fine powder. Plural species of treating agents can be used in combination.

Examples of silazanes and silane compounds having a nitrogen atom directly bonded to silicon atoms may include: hexamethyldisilazane, 1,3-bis(chloromethyl)-1,1,3,3-tetramethyldisilazane, bis(diethylamino)dimethylsilane, bis(dimethylamino)-diphenylsilane, bis(dimethylamino)methylvinylsilane, bis(ethylamino)dimethylsilane, bis-N,N'-(trimethyl-silyl)piperazine, t-butylaminotriethylsilane, t-butyldimethylaminosilane, t-butyldimethylsilyl-imidazole, t-butyldimethylsilylpyrrole, N,N'-diethylaminotrimethylsilane, 1,3-di-n-octyltetramethyldisilazane, 1,3-diphenyltetramethyldisilazane, 1,3-divinyltetramethyldisilazane, heptamethyldisilazane, 1,1,3,3,5,5-hexamethylcyclotrisilazane, nonamethyltrisilazane, octamethylcyclotetrasilazane, 1,1,3,3-tetramethyldisilazane, 2,2,5,5-tetramethyl-2,5-disila-1-aza-cyclopentane, 1,3,5,7-tetramethyl-1,3,5,7-tetravinylcyclotetrasilazane, 1,1,3,3-tetraphenyl-1,3-dimethyldisilazane, N-trimethylsilylimidazole, N-trimethylsilylmorpholine, N-trimethylsilylpiperazine, N-trimethylsilylpyrrole, N-trimethylsilyltriazole, 1,3,5-trimethyl-1,3,5-trivinylcyclotrisilazane, hexaphenylcyclodisilazane, and silazanes having a siloxane unit as a substituent. Silazane compounds are particularly preferred in view of a high hydrophobicity and easy pH adjustment, thus allowing easy balance between the performances in low and high humidity environments.

The silane compounds having a nitrogen-containing substituent may include silane compounds represented by the following formula (1), silane coupling agents having a nitrogen-containing substituent, siloxanes having a nitrogen-containing substituent, and silazanes having a nitrogen-containing substituent.

$$(R_{11})_pSiY_{4-p} \quad (1),$$

wherein $R_{11}$, denotes an amino group or an organic group having at least one nitrogen atom; Y denotes an alkoxy group or a halogen atom; and p denotes an integer of 1–3. The organic group having at least one nitrogen atom may include, e.g., an amino group having an organic substituent group, a saturated nitrogen-containing heterocyclic group, and a group having an unsaturated nitrogen-containing heterocyclic group. Examples of the heterocyclic group may include those represented by the following formulae. Groups having five-membered rings or six-membered rings are particularly preferred in view of the stability.

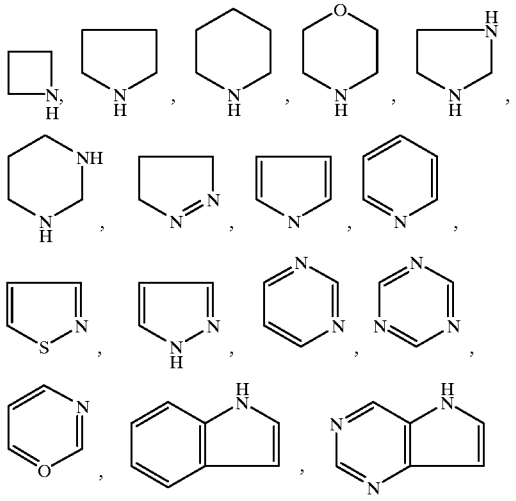

Examples of the silane compound and the silane coupling agent having a nitrogen-containing substituent may include: aminopropyltrimethoxysilane, aminopropyltriethoxysilane, dimethylaminopropyl-trimethoxysilane, dimethylaminopropylmethyldiethoxysilane, diethylaminopropyltrimethoxysilane, dipropylaminopropyltrimethoxysilane, dibutylaminopropyltrimethoxysilane, monobutylaminopropyltrimethoxysilane, dioctylaminopropyltrimethoxysilane, dibutylaminopropylmethyldimethoxysilane, dibutylaminopropyldimethylmonomethoxysilane, dimethylaminophenyltriethoxysilane, trimethoxysilyl-γ-propylphenylamine, trimethoxysilyl-γ-propylbenzylamine, trimethoxysilyl-γ-propylpiperidine, trimethoxysilyl-γ-propylmorpholine, trimethoxysilyl-γ-propylimidazole, γ-aminopropyldimethylmethoxysilane, γ-aminopropylmethyldimethoxysilane, 4-aminobutyldimethylmethoxysilane, 4-aminobutylmethyldiethoxysilane, and N-(2-aminoethyl) aminopropyldimethylmethoxysilane.

Examples of the silazanes having a nitrogen-containing substituent may include: 1,3-bis(3-aminopropyl)-1,1,3,3-tetramethyldisilazane, 1,3-bis(4-aminobutyl)-1,1,3,3-tetraethyldisilazane, 1,3-bis{N-(2-aminoethyl) aminopropyl}-1,1,3,3-tetramethyldisilazane, 1,3-bis (dimethylaminopropyl)-1,1,3,3-tetramethyldisilazane, 1,3-bis(3-propylaminopropyl)- 1,1,3,3-tetramethyldisilazane, and 1,3-bis(3-aminopropyl)-1,1,3,3-tetramethyldisilazane.

Examples of the siloxanes having a nitrogen-containing substituent may include: 1,3-bis(3-aminopropyl)-1,1,3,3-tetramethyldisiloxane, 1,3-bis(4-aminopropyl)-1,1,3,3-tetramethyldisiloxane, 1,3-bis{N-(2-aminoethyl) aminopropyl}-1,1,3,3-tetramethyl-disiloxane, 1,3-bis (dimethylaminopropyl)-1,1,3,3-tetramethyldisiloxane, 1,3-bis(diethylaminopropyl)-1,1,3,3-tetramethyldisiloxane, 1,3-bis(3-propylaminopropyl)-1,1,3,3-tetramethyldisiloxane, and 1,3-bis(3-aminopropyl)-1,1,3,3-tetramethyldisiloxane.

The silicone oils having a nitrogen-containing substituent may include: nitrogen-containing silicone oils having a polysiloxane skeleton including Si atoms to which any of hydrogen, methyl, phenyl and partially or wholly fluorine-substituted alkyl groups are attached, and further including a nitrogen-containing substituent introduced at a side chain, two terminal, one terminal of a side chain, or two terminals of a side chain of the polysiloxane skeleton. Those having a nitrogen-containing substituent of the following formulae are preferred:

$$—R—NR_{12}R_{13},\ —R'—NR_{14}—R''—NR_{15}R_{16},$$

$$—R—R_{17},\ \text{and}\ —R—NR_{14}—R_{17},$$

wherein R, R' and R" denote a phenylene group or an alkylene group; $R_{12}$, $R_{13}$, $R_{15}$ and $R_{16}$ denote hydrogen or an alkyl or aryl group capable of having a substituent; and $R_{17}$ denotes a nitrogen-containing heterocyclic group. These substituents can assume a form of ammonia salt.

These silicone oils can also have another substituent group, such as epoxy, polyether, methylstyryl, alkyl, fatty acid ester, alkoxy, carboxyl, carbinol, methacryl, mercapto, phenol or vinyl.

The nitrogen-containing silicone oil may preferably have a viscosity of at most 5000 $mm^2$/sec. Above 5000 $mm^2$/sec, the dispersion becomes insufficient and uniform treatment becomes difficult. The silicone oil may preferably have an amine equivalent (i.e., the quotient of molecular weight by a number of amine groups per molecule) of 200–40,000, more preferably 300–30000. If the amine equivalent exceeds 40000, the charge relaxation effect becomes insufficient in some cases, and below 200, the charge leakage becomes excessive in some cases. It is possible to use plural species of nitrogen-containing silicone oils in combination. A specific example may include an amino-modified silicone oil and an amino-modified silicone oil further modified with another functional group.

Other surface treating silane compounds used for providing the inorganic fine powder B or C may include: alkoxysilanes, such as methoxysilane, ethoxysilane, and propoxysilane; halosilanes, such as chlorosilane, bromosilane and iodosilane; hydrosilanes, alkylsilanes, arylsilanes, vinylsilanes, acrylsilanes, epoxysilanes, silyl compounds, siloxanes, silylureas, silylacetoamides, and silane compounds having a plurality of different functional groups possessed by these silane compounds. Specific examples of such silane compounds may include: trimethylsilane, trimethylchlorosilane, trimethylethoxysilane, dimethyldichilorosilane, methyltrichlorosilane, t-butyldimethylmethoxysilane, allyldimethylchlorosilane, allylphenyldichlorosilane, benzylmethyldichlorosilane, bromomethyldimethylchlorosilane, o-chlooethyltrichlorosilane, β-chloroethyltrichlorosilane, chloromethyldimethylchlorosilane, triorganosilylmercaptan, trimethylsilylmercaptan, triorganosilyl acrylate, vinyldimethylacetoxysilane, dimethyldiethoxysilane, dimethyldimethoxysilane, diphenyldiethoxysilane, N,O-(bistrimethylsilyl)-acetamide, N,N-bis(trimethylsilyl)urea, hexamethyl-disiloxane, 1,3-divinyltetramethyldisiloxane, 1,3-diphenyltetramethyldisiloxane, and dimethylpolysiloxanes having 2–12 siloxane units per molecule and a terminal silanol group.

Other surface-treating silicone oils may include: reactive silicones, such as epoxy-modified, carboxyl-modified, carbinol-modified, methacryl-modified, phenol-modified and plural functional group-modified silicones; non-reactive silicones, such as polyether-modified, methylstyryl-modified, alkyl-modified, aliphatic acid-modified, alkoxy-modified and fluorine-modified silicones; and straight silicones, such as dimethylsilicone, methylphenylsilicone, diphenylsilicone and methylhydrogensilicone.

Among these silicones, non-reactive silicones and straight silicones are preferred. Particularly, for providing the inorganic fine powder C, dimethylsilicone or methylhydrogensilicone is preferred.

These silicone oils may preferably have a viscosity at 25° C. of 5–2000 $mm^2$/sec, more preferably 10–1000 $mm^2$/sec. Below 5 $mm^2$/sec, an objective hydrophobicity cannot be attained in some cases. Above 2000 $mm^2$/sec, it becomes difficult to uniformly treat the inorganic fine powder, thus being liable to result in agglomerates and fail in providing a sufficient flowability, in some cases. These silicone oils can also be used in plural species in combination.

Each of the inorganic fine powders B and C may preferably have a BET specific surface area ($S_{BET}$) of at least 20 $m^2$/g, further preferably 30–400 $m^2$/g, particularly preferably 50–300 $m^2$/g. Below 20 $m^2$/g, the charge leakage and charge non-localization effects are liable to be inferior, so that a remarkable charge relaxation and uniformization effect cannot be expected in some cases. In excess of 400 $m^2$/g, the charge leakage becomes excessing in some cases.

The inorganic fine powders B and C may preferably be added in a proportion of 0.05–2.0 wt. parts per 100 wt. pats of the toner particles.

Each of the inorganic fine powders B and C may preferably be formed by treating 100 wt. parts of the inorganic fine powder with 1–40 wt. parts, more preferably 2–30 wt. parts, of the treating agent. Below 1 wt. part, the treatment effect is scarce, and in excess of 40 wt. parts, the agglomerates can be increased to result in a rather lower flowability.

More specifically, the silane compound having a nitrogen-containing substituent may preferably be used in 0.01–20 wt. parts, more preferably 0.05–15 wt. parts, particularly preferably 0.1–10 wt. parts, per 100 wt. parts of inorganic fine powder to be treated. Below 0.01 wt. part, the effects of preventing excessive charge due to charge leakage and also the stabilization of either positive or negative charge are liable to be insufficient. Above 20 wt. parts, the charge leakage is liable to be excessive, thus resulting in charging failure or insufficient charge in a high humidity environment. Further, a negatively chargeable toner is liable to suffer from occurrence of opposite polarity particles, and a positively chargeable toner is liable to suffer from excessive charge or selective development.

The silicone oil having a nitrogen-containing substituent may preferably be used in 0.1–30 wt. parts, more preferably 0.2–20 wt. parts, particularly preferably 0.5–15 wt. parts, per 100 wt. parts of inorganic fine powder to be treated. Below 0.1 wt. part, the effects of preventing excessive charge due to charge leakage and also the stabilization of either positive or negative charge are liable to be insufficient. Above 30 wt. parts, the charge leakage is liable to be excessive, thus resulting in charging failure or insufficient charge in a high humidity environment. Further, a negatively chargeable toner is liable to suffer from occurrence of opposite polarity particles, and a positively chargeable toner is liable to suffer from excessive charge or selective development.

In case of using several species of treating agents as described above, it is preferred that each treating agent is used in the above described range, and a total amount thereof is at most 50 wt. parts, more preferably 3–45 wt. parts, particularly preferably 6–40 wt, parts, per 100 wt. parts of inorganic fine powder to be treated. Above 50 wt. parts, agglomerates are liable to be formed and the treatment can be ununiform.

The measurement of the pH of inorganic fine powder may be performed by using a pH meter. More specifically, 4.0 g of a sample inorganic fine powder is taken in a beaker and 50 $cm^3$ of methanol is added thereto to wet the sample. Then, 50 $cm^3$ of pure water is added thereto, and the mixture is sufficiently stirred by a homomixer. Then, a pH value of the mixture is measured by using a pH meter.

Next, the toner particles for constituting the toner of the present invention together with the inorganic fine powder A will be described.

The binder resin for the toner used in the present invention may for example comprises: homopolymers of styrene and derivatives thereof, such as polystyrene, poly-p-chlorostyrene and polyvinyltoluene; styrene copolymers such as styrene-p-chlorostyrene copolymer, styrene-vinyltoluene copolymer, styrene-vinylnaphthalene copolymer, styrene-acrylate copolymer, styrene-methacrylate copolymer, styrene-methyl-α-chloromethacrylate copolymer, styrene-acrylonitrile copolymer, styrene-vinyl methyl ether copolymer, styrene-vinyl ethyl ether copolymer, styrene-vinyl methyl ketone copolymer, styrene-butadiene copolymer, styrene-isoprene copolymer and styrene-acrylonitrile-indene copolymer; polyvinyl chloride, phenolic resin, natural resin-modified phenolic resin, natural resin-modified maleic acid resin, acrylic resin, methacrylic resin, polyvinyl acetate, silicone resin, polyester resin, polyurethane, polyamide resin, furan resin, epoxy resin, xylene resin, polyvinyl butyral, terpene resin, chmarone-indene resin and petroleum resin. Preferred classes of the binder resin may include styrene copolymers and polyester resins.

Examples of the comonomer constituting such a styrene copolymer together with styrene monomer may include other vinyl monomers inclusive of: monocarboxylic acids having a double bond and derivative thereof, such as acrylic acid, methyl acrylate, ethyl acrylate, butyl acrylate, dodecyl acrylate, octyl acrylate, 2-ethyhexyl acrylate, phenyl acrylate, methacrylic acid, methyl methacrylate, ethyl methacrylate, butyl methacrylate, octyl methacrylate, acrylonitrile, methacrylonitrile, and acrylamide; dicarboxylic acids having a double bond and derivatives thereof, such as maleic acid, butyl maleate, methyl maleate and dimethyl maleate; vinyl esters, such as vinyl chloride, vinyl acetate, and vinyl benzoate; ethylenic olefins, such as ethylene, propylene and butylene; vinyl ketones, such as vinyl methyl ketone and vinyl hexyl ketone; and vinyl ethers, such as vinyl methyl ether, vinyl ethyl ether, and vinyl isobutyl ether. These vinyl monomers may be used alone or in mixture of two or more species in combination with the styrene monomer.

It is possible that the binder resin inclusive of styrene polymers or copolymers has been crosslinked or can assume a mixture of crosslinked and un-crosslinked polymers.

The crosslinking agent may principally be a compound having two or more double bonds susceptible of polymerization, examples of which may include: aromatic divinyl compounds, such as divinylbenzene, and divinylnaphthalene; carboxylic acid esters having two double bonds, such as ethylene glycol diacrylate, ethylene glycol dimethacrylate and 1,3-butanediol dimethacrylate; divinyl compounds, such as divinylaniline, divinyl ether, divinyl sulfide and divinylsulfone; and compounds having three or more vinyl groups. These may be used singly or in mixture.

Such a styrene copolymer may be produced through any of bulk polymerization, solution polymerization, suspension polymerization and emulsion polymerization. According to the bulk polymerization, however, even a low-molecular weight polymer can be produced by adopting a high polymerization temperature providing an accelerated reaction speed, the reaction cannot be controlled easily. In contrast thereto, according to the solution polymerization process, such a low-molecular weight polymer can be produced under moderate conditions by utilizing the radical chain transfer function of the solvent and by adjusting the polymerization initiator amount or reaction temperature, so that the solution polymerization process is preferred for formation of a low-molecular weight polymer giving a GPC chromatogram exhibiting a peak in a molecular weight region of $5\times10^3$ to $10^5$.

As a solvent used in the solution polymerization, it is possible to use xylene, toluene, cumene, cellosolve acetate, isopropyl alcohol, benzene, etc. For production of a styrene copolymer, it is preferred to use xylene, toluene or cumene. The solvent may be selected depending on the specific polymer to be produced.

The reaction temperature may vary depending on the solvent and initiator used and polymer to be produced but may suitably be within a range of 70–230° C. In the solution polymerization, it is preferred to use a monomer in a proportion of 30–400 wt. parts per 100 wt. parts of the solvent.

It is also preferred to add another polymer into the solution after the solution polymerization, whereby a binder resin comprising several species of polymers can be effectively mixed.

On the other hand, in order to provide a high-molecular weight polymer giving a peak in a molecular weight region of $3\times10^5$–$5\times10^5$ on a GPC chromatogram, or a crosslinked polymer, it is preferred to use emulsion polymerization or suspension polymerization.

In the emulsion polymerization process, a monomer almost insoluble in water is dispersed as minute particles in an aqueous phase with the aid of an emulsifier and is polymerized by using a water-soluble polymerization initiator. According to this method, the control of the reaction temperature is easy, and the termination reaction velocity is small because the polymerization phase (an oil phase of the vinyl monomer possibly containing a polymer therein) constitute a separate phase from the aqueous phase. As a result, the polymerization velocity becomes large and a polymer having a high polymerization degree can be prepared easily. Further, the polymerization process is relatively simple, the polymerization product is obtained in fine particles, and additives such as a colorant, a charge control agent and others can be blended easily for toner production. Therefore, this method can be advantageously used for production of a toner binder resin.

In the emulsion polymerization, however, the emulsifier added is liable to be incorporated as an impurity in the polymer produced, and it is necessary to effect a post-treatment such as salt-precipitation in order to recover the product polymer at a high purity. The suspension polymerization is more convenient in this respect.

The suspension polymerization may preferably be performed by using at most 100 wt. parts, preferably 10–90 wt. parts, of a monomer (mixture) per 100 wt. parts of water or an aqueous medium. The dispersing agent may include polyvinyl alcohol, partially saponified form of polyvinyl alcohol, and calcium phosphate, and may preferably be used in an amount of 0.05–1 wt. part per 100 wt. parts of the aqueous medium. The polymerization temperature may suitably be in the range of 50–95° C. and selected depending on the polymerization initiator used and the objective polymer. A water-insoluble or -hardly soluble polymerization initiator may suitably be used.

Examples of the initiator used in these polymerization processes may include: t-butylperoxy-2-ethylhexanoate, cumyl perpivalate, t-butyl peroxylaurate, benzoyl peroxide, lauroyl peroxide, octanoyl peroxide, di-t-butyl peroxide, t-butylcumul peroxide, dicumul peroxide, 2,2'-azobisisobutylo-nitrile, 2,2'-azobis(2-methylbutyronitrile), 2,2'-azobis(2,4-dimethylvaleronitrile), 2,2'-azobis(4-methoxy-2,4-dimethylvaleronitrile), 1,1-bis(t-butylperoxy)-3,3,5-trimethylcyclohexane, 1,1-bis(t-butylperoxy) cyclohexane, 1,4-bis(t-butylperoxy-carbonyl)cyclohexane, 2,2-bis(t-butylperoxy)octane, n-butyl-4,4-bis(t-butylperoxy) valerate, 2,2-bis(t-butylperoxy)butane, 1,3-bis(t-butylperoxyisopropyl)-benzene, 2,5-dimethyl-2,5-di(t-butylperoxy)hexane, 2,5-dimethyl-2,5-di(benzoylperoxy) hexane, di-t-butyldiperoxyisophthalate, 2,2-bis(4,4-di-t-butyl-peroxycyclohexyl)propane, di-t-butylperoxy-α-methylsuccinate, di-t-butylperoxydimethylglutarate, di-t-butylperoxyhexahydroterephthalate, di-t-butylperoxyazelate, 2,5-dimethyl-2,5-di-(t-butylperoxy) hexane, diethylene glycol-bis(t-butylperoxycarbonate), di-t-butylperoxytrimethyl-azipate, tris(t-butylperoxy)triazine, and vinyl-tris(t-butylperoxy)silane. These initiators may be used singly or in combination in an amount of at least 0.05 wt. part, preferably 0.1–15 wt. parts, per 100 wt. parts of the monomer.

It is also preferred to use a polyester resin as the binder resin. A preferred composition of such a polyester resin is described below.

Examples of a dihydric alcohol component may include: diols, such as ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, hydrogenated bisphenol A, bisphenols and derivatives represented by the following formula (A):

(A)

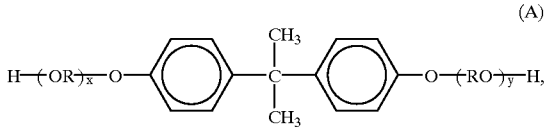

wherein R denotes an ethylene or propylene group, x and y are independently 0 or a positive integer with the proviso that the average of x+y is in the range of 0–10; diols represented by the following formula (B):

(B)

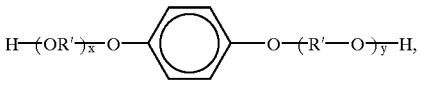

wherein R' denotes

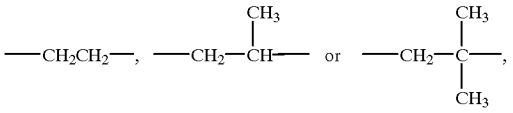

x' and y' are independently 0 or a positive integer with the proviso that the average of x'+y' is in the range of 0–10.

Examples of a dibasic acid may include benzenedicarboxylic acids, such as phthalic acid, terephthalic acid and isophthalic acid, and their anhydrides and lower alkyl esters; alkyldicarboxylic acids, such as succinic acid, adipic acid, sebacic acid and azelaic acid, and their anhydrides and lower alkyl esters; alkyl or alkenyl-substituted succinic acids, such as n-dodecylsuccinic acid or n-dodecenylsuccinic acid, and their anhydrides and lower alkyl esters; and unsaturated dicarboxylic acids, such as fumaric acid, maleic acid, citraconic acid and itaconic acid, and their anhydrides, and derivatives of these.

It is preferred to use a polyhydric alcohol or/and a polybasic acid each having three or more functional groups also functioning as a crosslinking component in combination with the above mentioned alcohol and acid.

Examples of such polyhydric alcohols may include: sorbitol, 1,2,3,6-hexanetetrol, 1,4-sorbitane, pentaerythritol, dipentaerythritol, tripentaerithritol, 1,2,4-butanetriol, 1,2,5-pentanetriol, glycerol, 2-methylpropanetriol, 2-methyl-1,2,4-butanetriol, trimethylolethane, trimethylolpropane, and 1,3,5-trihydroxybenzene.

Examples of polybasic carboxylic acids may include: trimellitic acid, pyromellitic acid, 1,2,4-benzentricarboxylic acid, 1,2,5-benzentricarboxylic acid, 2,5,7-naphthalenetricarboxylic acid, 1,2,4-naphthalenetricarboxylic acid, 1,2,4-butanetri-carboxylic acid, 1,2,5-hexanetricarboxylic acid, 1,2,5-hexanetricarboxylic acid, 1,3-dicarboxyl-2-methyl-2-methylenecarboxypropane, tetra(methylenecarboxyl) methane, 1,2,7,8-octanetetracarboxylic acid, empole trimer acid, and their anhydrides and lower alkyl esters; and also tetracarboxylic acids represented by the formula of:

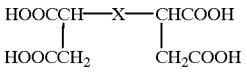

(wherein X is an alkylene or alkenylene group having 1–30 carbon atoms and capable of having one or more side chains of one or more carbon atoms) and anhydride and lower alkyl esters thereof.

The polyester may desirably comprise 40–60 mol. %, preferably 45–55 mol. % of alcohol component and 60–40 mol. %, preferably 55–45 mol. % of acid component. The polyfunctional component having three or more functional groups may be used in a proportion of 1–60 mol. % of the total components.

In addition to the above-mentioned binder resin components, the toner according to the present invention can further contain another resin component, such as silicone resin, polyurethane, polyamide, epoxy resin, polyvinylbutyral, rosin, modified rosin, terpen resin, phenolic resin and copolymers of two or more species of α-olefins, in an amount less than the above-mentioned binder resin components.

The binder resin constituting the toner particles of the present invention may preferably have a glass transition temperature (Tg) of 45–80° C., more preferably 50–70° C.

For the purpose of improving the low-temperature fixability and anti-high temperature offset property, the toner particles may preferably contain a wax or release agent.

Examples of the wax used in the present invention may include: aliphatic hydrocarbon waxes, such as low-molecular weight polyethylene, low-molecular weight polypropylene, olefin copolymers, microcrystalline wax, paraffin wax, and sasol wax; oxidation products of aliphatic hydrocarbon waxes, such as oxidized polyethylene wax; block copolymers of the above; waxes consisting principally of aliphatic acid esters, such as carnauba wax and montanate ester wax; and partially or totally deacidified aliphatic esters, such as deacidified carnauba wax. Further examples of the release agent may include: saturated linear aliphatic acids, such as palmitic acid, stearic acid, montanic acid, and long-chain alkylcarboxylic acid having a further long alkyl chain; unsaturated aliphatic acids, such as brassidic acid, eleostearic acid and parinaric acid; saturated alcohols, such as stearyl alcohol, eicosyl alcohol, behenyl alcohol, carnaubyl alcohol, ceryl alcohol, melissyl alcohol, and long-chain alkyl alcohols having a further long alkyl chain; polyhydric alcohols, such as sorbitol; aliphatic acid amides, such as linoleylamide, oleylamide, and laurylamide; saturated aliphatic acid bisamides, methylene-bisstearylamide, ethylene-biscaprylamide, ethylene-bislaurylamide, and hexamethylene-bisstearylamide; unsaturated aliphatic acid amides, such as ethylene-bisolerylamide, hexamethylene-bisoleylamide, N,N'-dioleyladipoylamide, and N,N'-dioleylsebacoylamide, aromatic bisamides, such as m-xylene-bisstearoylamide, and N,N'-distearylisophthalylamide; grafted waxes obtained by grafting aliphatic hydrocarbon waxes with vinyl monomers, such as styrene and acrylic acid; partially esterified products between aliphatic acids and polyhydric alcohols, such as behenic acid monoglyceride; and methyl ester compounds having hydroxyl group as obtained by hydrogenating vegetable fat and oil.

A preferred class of waxes may include: polyolefins obtained through radical polymerization of olefins under high pressure, or by low-pressure polymerization in the presence of a Ziegler catalyst or other catalysts; wax obtained by fractionation and purification of low-molecular weight olefin polymers by-produced during polymerization olefin polymers; wax obtained by fractionation of distillation residues of hydrocarbons synthesized from a synthesis gas of carbon monoxide and hydrogen through the Arge process, a fractionation of hydrogenated products of such distillation residues. These waxes can contain an anti-oxidant. Other examples of waxes may include: those formed of linear alcohols, aliphatic acids, acid amides, esters and montanate derivatives. It is also preferred to use such waxes after removal of impurities, such as aliphatic acids.

A further preferred class of waxes may include: polymerizates of olefins, such as ethylene, and by-products thereof; and waxes principally comprising hydrocarbons having up to several thousands of carbon atoms. It is also preferred to use a long-chain alcohol having up to several hundreds of carbon atoms and a terminal hydroxyl group. It is also preferred to alkylene oxide-adducts of alcohols.

It is further preferred to use a wax product having a narrower molecular weight distribution obtained by fractionating the above waxes according to press sweating, solvent method, vacuum distillation, supercritical gas extraction or fractional crystallization (e.g., melt-crystallization or crystal filtration) so as to fractionate the waxes according to molecular weights, as it contains a larger proportion of component exhibiting a desired range of melt behavior. It is particularly preferred to use two or more of such wax fractions in combination so as to provide a good balance of low-temperature fixability, anti-blocking property and anti-high temperature offset characteristic by incorporating components exhibiting melt-behaviors desired for such a combination in appropriate amounts without loss in the product toner.

The toner according to the present invention may preferably further contain a positive or negative charge control agent.

Examples of the positive charge control agents may include: nigrosine and modified products thereof with aliphatic acid metal salts, etc., onium salts inclusive of quaternary ammonium salts, such as tributylbenzylammonium 1-hydroxy-4-naphtholsulfonate and tetrabutylammonium tetrafluoroborate, and their homologous inclusive of phosphonium salts, and lake pigments thereof; triphenylmethane dyes and lake pigments thereof (the laking agents including, e.g., phosphotungstic acid, phosphomolybdic acid, phosphotungsticmolybdic acid, tannic acid, lauric acid, gallic acid, ferricyanates, and ferrocyanates); higher aliphatic acid metal salts; diorganotin oxides, such as dibutyltin oxide, dioctyltin oxide and dicyclohexyltin oxide; diorganotin borates, such as dibutyltin borate, dioctyltin borate and dicyclohexyltin borate; quanidine compounds, and imidazole compounds. These may be used singly or in mixture of two or more species. Among these, it is preferred to use a triphenylmethane compound, an imidazole compound or a quaternary ammonium salt having a non-halogen counter ion. It is also possible to use as a positive charge control agent a homopolymer of or a copolymer with another polymerizable monomer, such as styrene, an acrylate or a methacrylate, as described above of a monomer represented by the following formula (1):

(1)

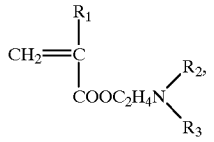

wherein $R_1$ denotes H or $CH_3$; $R_2$ and $R_3$ denotes a substituted or unsubstituted alkyl group (preferably $C_1$–$C_4$). In this instance, the homopolymer or copolymer may be function as (all or a portion of) the binder resin.

It is particularly preferred to use a triphenylmethane compound of the following formula (2) as a positive charge control agent:

(2)

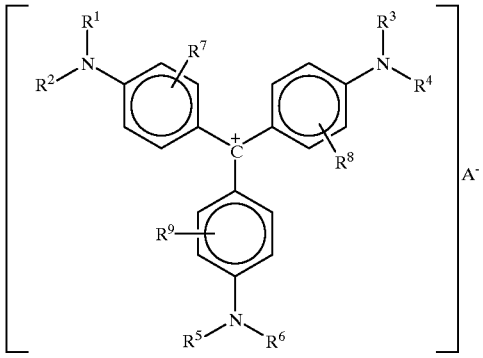

wherein $R^1$, $R^2$, $R^3$, $R^4$, $R^5$ and $R^6$ independently denote a hydrogen atom, a substituted or unsubstituted alkyl group, or a substituted or unsubstituted aryl group; $R^7$, $R^8$ and $R^9$ independently denote a hydrogen atom, a halogen atom, an alkyl group, or an alkoxy group; $A^-$denotes an anion selected from sulfate, nitrate, borate, phosphate, hydroxyl, organo-sulfate, organo-sulfonate, organo-phosphate, carboxylate, organo-borate and tetrafluoroborate ions.

Examples of the negative charge control agent may include: organic metal complexes, chelate compounds, monoazo metal complexes, acetylacetone metal complexes, organometal complexes of aromatic hydroxycarboxylic acids and aromatic dicarboxylic acids, metal salts of aromatic hydroxycarboxylic acids, metal salts of aromatic polycarboxylic acids, and anhydrides and esters of such acids, and phenol derivatives.

It is also preferred to use as a negative charge control agent an azo metal complex represented by the following formula (3):

(3)

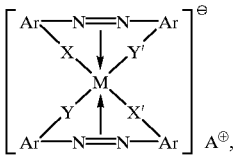

wherein M denotes a coordination center metal, such as Sc, Ti, V, Cr, Co, Ni, Mn or Fe; Ar denotes an aryl group, such as phenyl or naphthyl, capable of having a substituent, examples of which may include: nitro, halogen, carboxyl, anilide, or alkyl or alkoxy having 1–18 carbon atoms; X, X', Y and Y' independently denote a bonding agent of —O—, —CO—, —NH—, or —NR— (wherein R denotes an alkyl having 1–4 carbon atoms; and $A^{\oplus}$ denotes a cation, such as hydrogen, sodium, potassium, ammonium or aliphatic ammonium. The cation $A^{\oplus}$ can be a mixture of these or can be omitted some cases.

It is particularly preferred that the center metal is Fe or Cr; and the substituent is halogen, alkyl or anilide group.

It is also preferred to use as a negative charge control agent as a basic organic acid metal compound represented by the following formula (4):

(4)

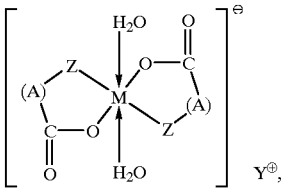

wherein M denotes a coordination center metal, such as Cr, Co, Ni, Mn, or Fe; A denotes

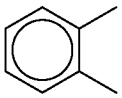

(capable of having a substituent, such as $C_1$–$C_{18}$ alkyl, nitro, halogen, anilide or aryl,

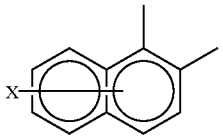

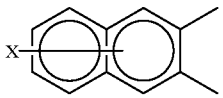

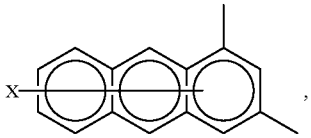

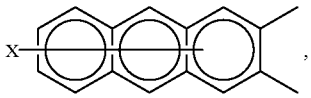

(X denotes hydrogen, halogen, nitro, or $C_1$–$C_{18}$ alkyl),

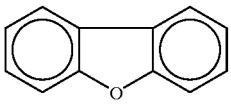

-continued

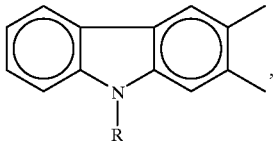

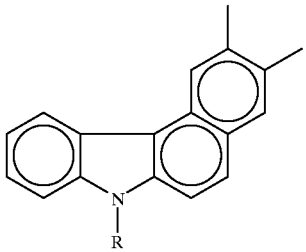

(R denotes hydrogen, $C_1$–$C_{18}$ alkyl or $C_1$–$C_{18}$ alkenyl); $Y^{\oplus}$ denotes a cation, such as hydrogen, sodium, potassium, ammonium, or aliphatic ammonium; and Z denotes —O— or —CO—O—. The cation can be omitted.

It is particularly preferred that the center metal is Fe, Cr, Si, Zn or Al; the substituent is alkyl or preferably $C_1$–$C_{18}$, anilide or aryl group or halogen, more preferably alkyl or halogen; and the cation is hydrogen, ammonium or aliphatic ammonium.

Such a charge control agent may be incorporated in a toner by internal addition into the toner particles or external addition to the toner particles. The charge control agent may be added in a proportion of 0.1–10 wt. parts, preferably 0.1–5 wt. parts, per 100 wt. parts of the binder resin while it can depend on the species of the binder resin, other additives, and the toner production process including the dispersion method.

Regardless of whether the toner according to the present invention is used to provide a monocomponent developer or two-component developer, the toner contain any colorant, inclusive of carbon black, aniline black, acetylene black, titanium white, and other pigments and/or dyes.

For example, in case where the toner of the present invention is used as a magnetic color toner, the toner can contain a dye, such as C.I. Direct Red 1, C.I. Direct Red 4, C.I. Acid Red 1, C.I. Basic Red 1, C.I. Mordant Red 30, C.I. Direct Blue 1, C.I. Direct Blue 2, C.I. Acid Blue 9, C.I. Acid Blue 15, C.I. Basic Blue 3, C.I. Basic Blue 5, C.I. Modant Blue 7, C.I. Direct Green 6, C.I. Basic Green 4, and C.I. Basic Green 6; or a pigment, such as Chrome Yellow, Cadmium Yellow, Mineral Fast Yellow, Navre Yellow, Naphthol Yellow S, Hansa Yellow G, Permanent Yellow NCG, Turtradine Lake, and Chrome Yellow, Molybdenum Orange, Permanent Orange GTR, Pyrazolone Orange, Benzidine Orange G, Cadmium Red, Permanent Red 4R, Watching Red Ca-salt, Eosin Lake, Brilliant Carmine 3B, Manganese Violet, Fast Violet B, Methyl Violet Lake, Ultramarine, Cobalt Blue, Alkali Blue Lake, Victoria Blue Lake, Phthalochanine Blue, Fast Sky Blue, Indanthrene Blue BC, Chrome Green, chromiun oxide, Pigment Green B, Malachite Green Lake, and Final Yellow Green G.

Further, in case where the toner of the present invention is used as a two-component type full color toner, a magnetic colorant, a cyan colorant, and a yellow colorant, as described below, may be used.

Examples of the magenta pigment may include: C.I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48, 49, 50, 51, 52, 53, 54, 55, 57, 58, 60, 63, 64, 68, 81, 83, 87, 88, 89, 90, 112, 114, 122, 123, 163, 202, 206, 207, 209, C.I. Pigment Violet 19, C.I. Vat Red 1, 2, 10, 13, 15, 23, 29, 35.

These magenta pigments can be used alone but may preferably be used in combination with a magenta dye so as to provide an improved clarity suitable for full-color image formation. Examples of such magenta dye may include: oil soluble dyes, such as C.I. Solvent Red 1, 3, 8, 23, 24, 25, 27, 30, 49, 81, 82, 83, 84, 100, 109, 121, C.I. Disperse Red 9, C.I. Solvent Violet 8, 13, 14, 21, 27 and C.I. Disperse Violet 1; and basic dyes such as C.I. Basic Red 1, 2, 9, 12, 13, 14, 15, 17, 18, 22, 23, 24, 27, 29, 32, 34, 35, 36, 37, 38, 39, 40, C.I. Basic Violet 1, 3, 7, 10, 14, 15, 21, 25, 26, 27 and 28.

Examples of the cyan pigment may include: C.I. Pigment Blue 2, 3, 15, 16, 17, C.I. Vat Blue 6, C.I. Acid Blue 45, and copper phthalocyanine pigments represented by the following formula wherein 1–5 phthalimido groups attached to the phthalocyanine skeleton:

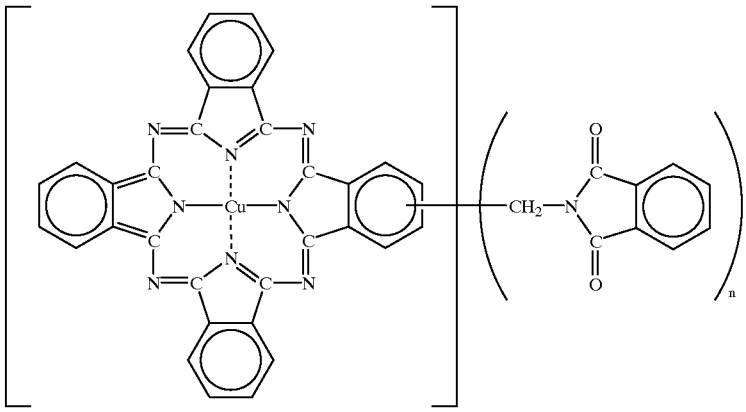

(n = 1–5)

Examples of the yellow pigments may include: C.I. Pigment Yellow 1, 2, 3, 4, 5, 6, 7, 10, 11, 12, 13, 14, 15, 16, 17, 23, 65, 73, 83 and C.I. Vat Yellow 1, 3, 30.

These colorants for full-color toners may be used in 0.1–60 wt. parts, preferably 0.1–50 wt. parts, more preferably 0.1–20 wt. parts, particularly preferably 0.3–10 wt. parts, per 100 wt. parts of the binder resin.

The toner according to the present invention can also be used as a magnetic toner by using a magnetic material as a colorant. Examples of the magnetic material used for this purpose may include: iron oxide, such as magnetite, hematite, and ferrite; metals, such as iron, cobalt and nickel, and alloys of these metals with other metals, such as aluminum, cobalt, copper, lead, magnesium, tin, zinc, antimony, beryllium, bismuth, cadmium, calcium, manganese, selenium, titanium, tungsten and vanadium; and mixtures of these materials.

The magnetic material may have an average particle size of at most 2 $\mu$m preferably 0.1–0.5 $\mu$m. The magnetic material may be contained in the toner in a proportion of ca. 20–200 wt. parts, preferably 40–150 wt. parts, per 100 wt. parts of the resin component.

The magnetic material may preferably have a saturation magnetization ($\sigma_{sat}$) of 5–200 $Am^2$/kg (emu/g), more preferably 10–150 $Am^2$/kg (emu/g), and a residual magnetization ($\sigma_r$) of 1–100 $Am^2$/kg (emu/g), more preferably 1–70 $Am^2$/kg (emu/g), respectively as measured under a magnetic field of $7.96\times10^2$ kA/m (10 kOe).

The magnetic values described herein are based on values measured by using an oscillating sample-type magnetometer ("VSM-3S-15", mfd. by Toei Kogyo K.K.) under application of an external magnetic field of $7.96\times10^2$ kA/m (10 kOe).

In the case of using the toner according to the present invention for constituting a two-component type developer, the toner may be blended with carrier powder in a ratio suitable for providing a toner concentration of 0.1–50 wt. %, preferably 0.5–10 wt. %, further preferably 3–10 wt. %. The carrier used for this purpose may be any of known ones, inclusive of powdery magnetic materials, such as surface-oxidized or -nonoxidized particles of metals, such as iron, nickel, cobalt, manganese, chromium and rare earth, and alloys and oxides of these, having an average particle size of preferably 20–300 $\mu$m.

It is further preferred to use such carrier particles after coating wholly or partially with a resin, such as styrene resin, acrylic resin, silicone resin, fluorine-containing resin or polyester resin.

The toner particles constituting the toner according to the present invention may be prepared through a process including: sufficiently blending the binder resin, the wax, a colorant, such as pigment, dye and/or a magnetic material, and an optional charge control agent and other additives, as desired, by means of a blender such as a Henschel mixer or a ball mill, melting and kneading the blend by means of hot kneading means, such as hot rollers, a kneader or an extruder to cause melt-kneading of the resinous materials and disperse or dissolve the wax, pigment or dye therein, and cooling and solidifying the kneaded product, followed by pulverization and classification.

The thus obtained toner particles are further blended with external additives, inclusive of the inorganic fine powder A, sufficiently by means of a mixer such as a Henschel mixer to obtain the toner according to the present invention.

The toner according to the present invention may preferably have a weight-average particle size (D4) of 4–13 $\mu$m, more preferably 5–12 $\mu$m. Below 4 $\mu$m, it becomes difficult to attain a sufficient image density. Above 13 $\mu$m, it becomes difficult to realize a high resolution image formation.

The weight-average particle size (D4) data described herein are based on the values measured by using Coulter Counter Model TA-II, but it is also possible to use Coulter Multisizer II (respectively available from Coulter Electronics Inc.). The measurement may be performed by using an electrolytic solution comprising a ca. 1% NaCl aqueous solution which may be prepared by dissolving a reagent-grade sodium chloride or commercially available as "ISOTON-II" (from Counter Scientific Japan). For measurement, into 10 to 150 ml of the electrolytic solution, 0.1 to 5 ml of a surfactant (preferably an alkyl benzenesulfonic acid salt) is added as a dispersant, and 2–20 mg of a sample is added. The resultant dispersion of the sample in the electrolytic solution is subjected to a dispersion treatment by an ultrasonic disperser for ca. 1–3 min., and then subjected to measurement of particle size distribution by using the above-mentioned apparatus equipped with a 100 pm-aperture. The volume and number of toner particles having particle sizes of 2.00 μm or larger are measured for respective channels to calculate a volume-basis distribution and a number-basis distribution of the toner. From the volume-basis distribution, a weight-average particle size ($D_4$) of the toner is calculated by using a central value as a representative for each channel.

The channels used include 13 channels of 2.00–2.52 μm; 2.52–3.17 μm; 3.17–4.00 μm; 4.00–5.04 μm; 5.04–6.35 μm; 6.35–8.00 μm; 8.00–10.08 μm 10.08–12.70 μm; 12.70–16.00 μm; 16.00–20.20 μm; 20.20–25.40 μm; 25.40–32.00 μm: and 32.00–40.30 μm.

In the image forming method according to the present invention using the above-described toner of the present invention, it is preferred to use an a-Si photosensitive member having an a-Si photosensitive layer on an electroconductive substrate as an electrostatic latent image-bearing member.

The a-Si photosensitive member may also have a lower charge injection-prevention layer below the photosensitive layer so as to prevent the charge injection from the substrate. Further, it is possible to dispose a surface protective layer above the photosensitive layer in order to provide an improved durability, and it is also possible to provide an upper charge injection-prevention layer on the photosensitive layer or between the surface protective layer and the photosensitive layer so as to prevent a latent image charge injection from the surface of the electrostatic image-bearing member. It is also possible to coat the photosensitive layer with a layer functioning as both the surface protective layer and the upper charge injection-prevention layer. Further, it is also possible to dispose a long-wavelength light-interrupting layer so as to prevent an interferential development with such long-wavelength light.

Respective layers as mentioned above may be formed so as to exhibit desired properties by selectively introducing, e.g., hydrogen atom; Group III atoms on the periodic table, such as boron, aluminum, and gallium; Group IV atoms on the periodic table, such a germanium and tin; Group IV atoms on the periodic table such as nitrogen, phosphorus and arsenic; Group V atoms, or the periodic table such as oxygen, sulfur and selenium; and Group VIII atoms on the periodic table, such as fluorine, chlorine and bromine, singly or in combination of two or more species during the a-Si layer formation, for controlling the respective properties.

For example, it is possible to obtain a desired a-Si photosensitive drum retaining thereon a negatively charged electrostatic image by successively forming a lower charge-injection prevention layer of hydrogenated a-Si (represented as a-Si:H) film doped with phosphorus (P), a photosensitive layer of non-doped a-Si:H film, and an upper charge-injection prevention layer of a-Si:H film doped with boron (B), in this order, or a drum substrate.

It is also possible to obtain a desired a-Si photosensitive drum retaining thereon a positively charged electrostatic image by successively forming a lower charge-injection prevention layer of a-Si:H film doped with boron (B), a photosensitive layer of non-doped a-Si:H film, and an upper charge-injection prevention layer of a-Si:H film doped with phosphorus (P), in this order, or a drum substrate.

By using such an a-Si photosensitive member, it is possible to form an electrostatic image-bearing member having a spectral sensitivity over a range of from visible light to semiconductor laser light, thereby allowing the formation of digital latent images on the electrostatic image-bearing member by exposure to laser beam spots from a semiconductor laser, etc.

Next, the image forming method according to the present invention is described with respect to an embodiment thereof. Referring to FIG. 1, a surface of a photosensitive member (latent image-bearing member) 1 is negatively or positively charged by a primary charger 2 and then exposed to image light 5 from an analog exposure system or a laser beam scanning system to form an electrostatic image (e.g., a digital latent image formed by image scanning), which is then developed according to a reversal development mode or a normal development mode with a toner 13 held in a developing device 10 equipped with a developing sleeve 4. At the developing position, a developing bias voltage of an alternating voltage, a pulse voltage or an AC voltage, is applied between the photosensitive member 1 and the developing sleeve 4 from a bias voltage application means. The thus formed toner image on the photosensitive member 1 is then transferred without via an intermediate transfer member (as in the embodiment shown in FIG. 1 or via an intermediate transfer member while not shown) onto a transfer material paper P conveyed to a transfer position by conveyer rollers. At the transfer position, a back side (an opposite side of the photosensitive member 1) of the transfer paper P is positively or negatively charged, whereby the negatively charged toner image or the positively charged toner image is electrostatically transferred onto the transfer paper P. The transfer paper P separated from the photosensitive member 1 and carrying the toner image is then conveyed to a heat-pressure fixing device 7 enclosing a heater 16 where the toner image is fixed onto the transfer paper P. The residual toner remaining on the photosensitive member 1 after the transfer position is removed by a cleaning means equipped with a cleaning blade 8 and a cleaning roller 9. The photosensitive member 1 after the cleaning is charge-removed by light from an erase exposure system 6 and again subjected to a subsequent image forming cycle starting from the charging step by the primary charger 2.

Next, some developing apparatus suitable for using the toner according to the present invention will be described.

Figure 2:
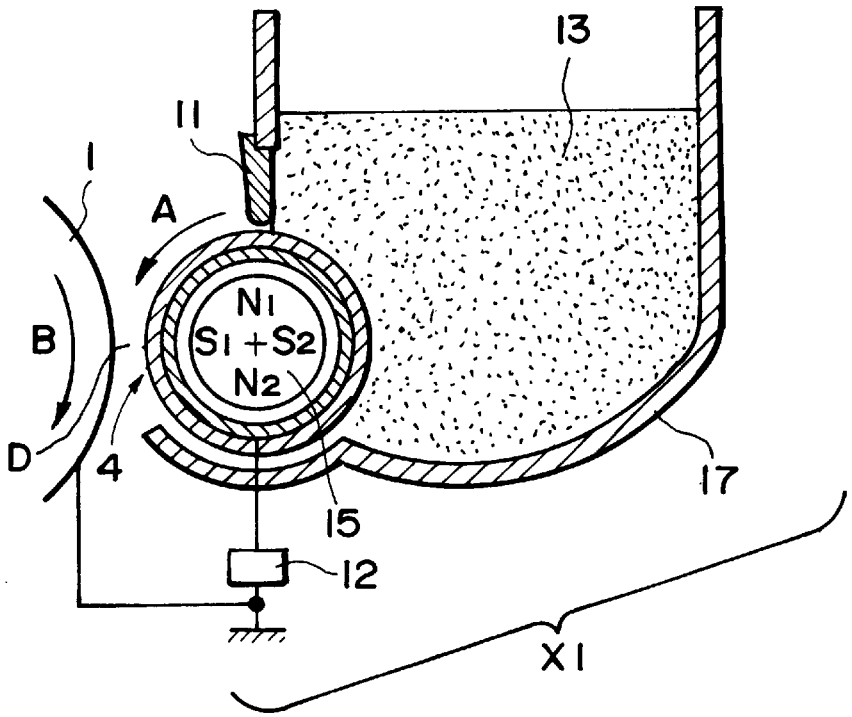
FIGS. 2 and 3 are respectively an enlarged side sectional illustration of a developing device suitable for practicing a developing step in the image forming method according to the invention.

Referring to FIG. 2, a developing apparatus X1 is operated in combination with an electrophotographic photosensitive drum 1 (as an example of an image-bearing member for bearing an electrostatic image formed by a known process) which is rotated in a direction of arrow B. On the other hand, a developing sleeve 4 (as a developer-carrying member) carrying a toner 13 supplied from a hopper 17 is rotated in a direction of arrow A to convey a layer of the toner 13 to a developing region D where the developing sleeve 4 and the photosensitive drum 1 oppose each other. In case where the toner 13 is a magnetic toner, a magnet 15 is disposed within the developing sleeve so as to magnetically attract and hold the magnetic toner 13 on the developing sleeve, whereby the toner is subjected to friction with the developing sleeve 4 to acquire a triboelectric charge sufficient for developing an electrostatic image on the photosensitive drum 1.

In order to regulate the layer thickness of the magnetic toner 13, a regulating magnetic blade 11 comprising a ferromagnetic metal is hung down from the hopper 17 to confront the developing sleeve 4 with a gap of ca. 200–300 μm from the surface of the developing sleeve 4. Lines of magnetic induction from a magnetic pole $N_1$ of the magnet 15 are concentrated to the blade 11, whereby a thin layer of the toner 13 is formed on the developing sleeve 4. The blade 11 can also comprise a non-magnetic blade.

The thin layer thickness of the toner 13 formed on the developing sleeve 4 may preferably be smaller than the minimum gap between the developing sleeve 4 and the photosensitive drum 1 at the developing region D. The present invention is particularly effective in such a developing apparatus for the scheme wherein an electrostatic image is developed with such a thin layer of toner, i.e., a non-contact type developing apparatus. However, the present invention is also applicable to a developing apparatus wherein the toner layer thickness is larger than the minimum gap between the developing sleeve 4 and the photosensitive drum 1 at the developing region, i.e., a contact-type developing apparatus.

Hereinbelow, further description of a non-contact type developing apparatus will be made.

Referring again to FIG. 2, the developing sleeve 4 is supplied with a developing bias voltage from a power supply 12 so as to cause a jumping of a toner 13 carried on the developing sleeve 4. In case where the developing bias voltage is a DC voltage, it is preferred that the developing sleeve 4 is supplied with a developing bias voltage which is equal to a voltage given as a difference between a potential of an image region (where the toner 13 is attached to provide a visual image region) and a potential of a background region of an electrostatic image. On the other hand, in order to increase the density or gradational characteristic of a developed image, it is also possible to apply an alternating bias voltage to the developing sleeve 4, thereby forming a vibrating field of which the voltage polarity alternates with time at the developing region. In this case, it is preferred that the developing sleeve 4 is supplied with an alternating bias voltage superposed with a DC voltage component equal to the above-mentioned difference between the image region potential and the background region potential.

Further, in the case of so-called normal development scheme wherein a toner is attached to a higher potential region of an electrostatic image having such a higher-potential region and a lower potential region, a toner charged to a polarity opposite to that of the electrostatic image is used. On the other hand, in the case of the reversal development scheme wherein a toner is attached to a lower-potential region of an electrostatic image, a toner charged to a polarity identical to that of the electrostatic image is used. Herein, a higher-potential and a lower-potential refers to potential in terms of absolute value. In any case, the toner 13 is triboelectrically charged due to friction between the toner 13 and the developing sleeve 4 to a polarity appropriate for developing an electrostatic image on the photosensitive drum 1.

Figure 3:
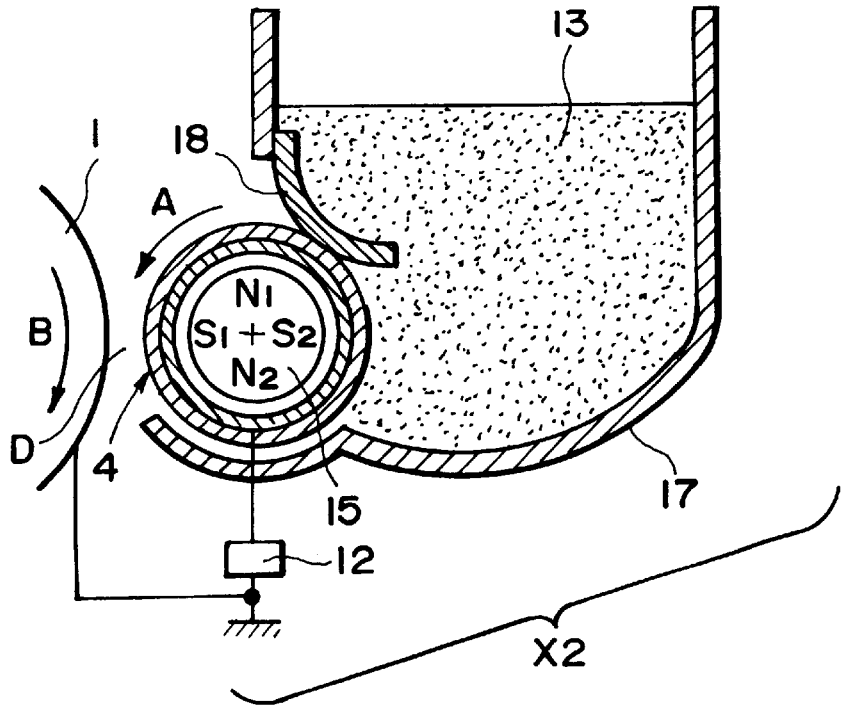

FIG. 3 shows another embodiment of developing apparatus.

In a developing apparatus X2 shown in FIG. 3, an elastic plate 18 comprising a material having a rubber elasticity, such as urethane rubber or silicone rubber, or a material having a metal elasticity, such as phosphor bronze or stainless steel, is used as a member for regulating the layer thickness of toner 13 on a developing sleeve 4, and the elastic plate 18 is pressed against the developing sleeve 4. In such a developing apparatus, a further thin toner layer can be formed on the developing sleeve 4. The other structure of the developing apparatus shown in FIG. 3 is basically identical to that of the apparatus shown in FIG. 2, and identical numerals in FIG. 3 represent identical members as in FIG. 2.

In the developing apparatus of FIG. 3, the toner is applied by rubbing with the elastic plate 18 onto the developing sleeve 4 to form a toner layer thereon, so that the toner can be provided with a larger triboelectric charge and thus results in a higher image density. This type of developing apparatus is preferably used for a non-magnetic mono-component toner.

Hereinbelow, the present invention will be described more specifically based on Examples.

(Production Examples 1–7 and Comparative Production Examples 1–2 for A-type inorganic fine powders)

Dressed bastnaesite was pulverized, dissolved in sulfuric acid and then subjected to solvent extraction and conversion into carbonate in different manners for providing 9 lots of rare earth carbonates having different contents of rear earth elements. Then, the rare earth carbonates were calcined into rare earth oxides, followed by standing for cooling, wet pulverization and addition of hydrofluoric acid for providing fluorine contents shown in Table 1 below, drying, calcination at 600–1000° C. for 5–10 hours in an electric furnace, pulverization and classification to obtain Inorganic fine powders A-1 to A-7 and Comparative Inorganic fine powders a-1 and a-2 having compositions and properties shown in Table 1 together with those of Comparative Inorganic fine powders a-3 and a-4 prepared in the following Comparative Production Examples.

(Comparative Production Example 3 for A-type inorganic fine powder)

Dressed bastnaesite was pulverized, dried, calcined for 5–10 hours at 600–1000° C. in an electric furnace, pulverized and classified to obtain Comparative Inorganic fine powder a-3.

(Comparative Production Example 4 for A-type inorganic fine powder)

Rare earth chloride obtained from dressed monazite was subjected to alkali decomposition to form rare earth hydroxide, which was then treated with acid, dried, calcined, pulverized and classified to obtain Comparative Inorganic fine powder a-4.

(Production of B-type and C-type inorganic fine powders)

In a vessel, 100 wt. parts of toluene and 200 wt. parts of silica were placed and stirred by a mixer to form a slurry, to which 6 wt. parts of γ-aminopropyltriethoxysilane and 34 wt. parts of dimethylsilicone oil (Viscosity: 50 $mm^2$/sec) were added and further stirred with a mixer. The resultant slurry was subjected to dispersion together with zirconia ball media for 30 min. in a sand mill. The slurry taken out of the sand mill was subjected to removal of the toluene at 60° C. under reduced pressure and then dried at 250° C. under stirring in a stainless steel vessel. Then, the dried product was disintegrated by a hammer mill to obtain Inorganic fine powder (i).

In similar manners as above except for using silica having different BET specific surface areas ($S_{BET}$) and treating agents as shown in Table 2 below, Inorganic fine powders (ii) and (iii) were prepared.

Separately, 200 wt. parts of silica was placed in a closed-type high speed stirring mixer and then aerated with nitrogen. Under stirring, 40 wt. parts of hexamethyldisilazane was sprayed onto the silica, followed by 10 min. of stirring at room temperature. Under high speed stirring, the system was heated to 300° C. and further stirred for 1 hour, followed by cooling to room temperature under stirring. The treated product was taken out of the mixer to obtain Inorganic fine powder (iv).

The properties of the above-prepared Inorganic fine powders (i)–(iv) are inclusively shown in Table 2 below.

Example 1

| | |
|---|---|
| Styrene-butyl acrylate copolymer (binder resin) | 100 wt. parts |
| Magnetic iron oxide (magnetic material) | 90 wt. parts |
| Triphenylmethane lake pigment (positive charge control agent) | 2 wt. parts |
| Low-molecular weight polyethylene (release agent) | 4 wt. parts |

The above ingredients were preliminarily blended within a Henschel mixer and then melt-kneaded through a twin-screw extruder set at 130° C. The melt-kneaded product was coarsely crushed by a cutter mill and then finely pulverized by a pulverizer using a jet air stream. The pulverized powder was classified by a multi-division classifier utilizing the Coanda effect to obtain toner particles. Then, 100 wt. parts of the toner particles were externally blended with 3.0 wt. parts of Inorganic fine powder A-1 and 1.0 wt. part or Inorganic fine powder (i) to obtain a positively chargeable toner (Toner 1). Toner 1 exhibited a weight-average particle size (D4) of 7.2 μm.

Toner 1 was incorporated in a commercially available copying machine having an a-Si photosensitive drum ("NP-6085", mfd. by Canon K.K.) after remodeling and subjected to a copying test. Th e re-modeling was performed so as to allow a reversal development using a positively chargeable toner by changing bias voltages, potential conditions, etc. (non-image part drum-potential=400 volts, image part drum potential=50 volts, developing bias DC component=280 volts, image potential contrast=230 volts, drum surface temperature=42° C.), and using a cleaning system including a magnetic cleaning roller having 8 poles exerting a magnetic flux density of 1000 gauss and a polyurethane rubber cleaning blade (hardness=70 deg., thickness=3 mm). The magnetic cleaning roller was rotated at a circumferential speed of 80% of that of the photosensitive drum in an identical direction while leaving a gap of 1.2 mm from the drum, and the cleaning blade was pressed against the drum so as to provide a pressing margin of 0.5 mm.

The copying test was performed as a continuous copying test on 100,000 sheets each in a normal temperature/low humidity environment (NT/LH) of 23° C./15% RH and in a high temperature/high humidity environment (HT/HH) of 30° C./80% RH, respectively. The evaluation was performed on the following items. The results are inclusively shown in Tables 3 and 4 appearing hereinafter together with those of the toners obtained in Examples and Comparative Examples described hereinafter.

1) Image Density

Reflection density of a round spot in a diameter of 5 mm was measured by using a Macbeth densitometer (available from Macbeth Co.) with an SPI filter.

2) Fog

A highest reflection density Ds at a white background portion of a transfer paper after copying and a reflection density Dr of the transfer paper before copying were measured by using a reflection densitometer ("Reflection Model TC6DS", available from Tokyo Denshoku K.K.), and a difference Ds−Dr was taken as a fog value. A smaller fog value represents a better fog suppression.

3) Toner Sticking on the Photosensitive Drum Surface

The photosensitive member after the continuous copying test on 100,000 sheets each in the NT/LH (23° C./5% RH) environment and HT/HH (30° C./80 % RH) environment was evaluated with respect to toner sticking and the influence of the toner sticking on the copied images obtained during the continuous copying was also evaluated, respectively with eyes according to the following standard.

A: Not observed at all.

B: Slightly observed but no influence on the images observed.

C: Sticking observed but little influence on the images observed.

D: Much sticking observed and remarkable influence on the images observed.

4) Image Flow

The copied images were evaluated with respect to image flow at the final stages of the continuous copying on 100,000 sheets each in the NT/LH (23° C./5% RH) environment and the HT/HH (30° C./80% RH) environment according to the following standard.

A: Not occurred.

B: Very slightly occurred.

C: Slightly occurred.

D: Occurred and resulted in a wide area of image blurring.

5) Toner Slipping by the Cleaning Blade

The cleaning blade after the continuous copying on 100,000 sheets each in the NT/LH (23° C./5% RH) environment and the HT/HH (30° C./80% RH) environment with respect the toner slipping by the cleaning blade and the influence thereof on the copied images during the continuous copying were evaluated with eyes according to the following standard.

A: Not occurred.

TABLE 3

Evaluation in NT/LH (23° C./5% RH) environment

| Ex. % Comp. Ex. | Inorganic fine powder A-type Add. amount (wt. parts) | | B type & C-type Add. amount (wt. parts) | | Toner D4 (μm) | Image density | Fog | Toner sticking | Image flow | Cleaner Slipping-by | Cleaner Leakage | Drum abrasion (nm) |
|---|---|---|---|---|---|---|---|---|---|---|---|---|
| Ex. 1 | A-1 | 3.0 | i | 1.0 | 7.2 | 1.45 | 0.5 | A | A | A | A | 4.7 |
| Ex. 2 | A-2 | 2.0 | i | 1.0 | 7.2 | 1.43 | 0.7 | B | A | A | B | 4.2 |
| Ex. 3 | A-3 | 1.0 | i | 1.0 | 7.2 | 1.38 | 1.0 | B | A | B | C | 3.3 |
| Ex. 4 | A-4 | 4.0 | ii | 0.8 | 7.2 | 1.36 | 1.1 | A | A | A | A | 5.7 |
| Ex. 5 | A-5 | 3.0 | ii | 0.8 | 7.2 | 1.42 | 0.8 | A | A | A | A | 5.1 |
| Ex. 6 | A-6 | 0.5 | iii | 1.0 | 6.5 | 1.39 | 1.4 | B | A | B | B | 11.0(μm) |

TABLE 3-continued

Evaluation in NT/LH (23° C./5% RH) environment

| Ex. % Comp. Ex. | Inorganic fine powder A-type Add. amount (wt. parts) | | B type & C-type Add. amount (wt. parts) | | Toner D4 (μm) | Image density | Fog | Toner sticking | Image flow | Cleaner Slipping-by | Cleaner Leakage | Drum abrasion (nm) |
|---|---|---|---|---|---|---|---|---|---|---|---|---|
| Ex. 7 | A-7 | 5.0 | iv | 1.0 | 7.8 | 1.43 | 0.9 | A | A | A | B | 6.2 |
| Ex. 8 | A-1 | 1.0 | i | 1.0 | 8.5 | 1.37 | 0.9 | B | A | B | B | — |
| Comp. Ex. 1 | a-1 | 3.0 | i | 1.0 | 7.2 | 1.35 | 1.2 | B | B | C | C | 14.6 |
| Comp. Ex. 2 | a-2 | 3.0 | i | 1.0 | 7.2 | 1.31 | 2.6 | B | C | A | B | 2.4 |
| Comp. Ex. 3 | a-3 | 3.0 | i | 1.0 | 7.2 | 1.30 | 1.9 | C | B | C | C | 2.6 |
| Comp. Ex. 4 | a-4 | 3.0 | i | 1.0 | 7.2 | 1.34 | 2.4 | B | A | B | D | 13.5 |

B: Agglomerate remained on the cleaning blade but no slipping-by observed.

C: Toner slipping-by was observed to result in streaks in the copied images.

6) Toner Leakage at the Cleaning Blade Edges

The cleaning blade and the photosensitive drum surface after the continuous copying on 100,000 sheets each in the NT/LH (23° C./5% RH) environment and the HT/HH (30° C./80% RH) environment were observed with eyes and evaluated according to the following standard.

A: No leakage occurred.

B: Very slight toner leakage from the blade ends was observed.

C: Toner leakage from the blade ends was observed but no toner sticking was observed at drum edges.

D: Toner melt-sticking was observed at drum edges.

7) Drum Abrasion

The film thickness on the drum was measured before and after the continuous copying on 100,000 sheets, and the difference was recorded in the unit of nm as a drum abrasion. Regarding Example 6 described hereinafter, the measurement was performed after continuous copying on 15,000 sheets, and the result is expressed in the unit of μm.

EXAMPLE 2

A positively chargeable toner (Toner 2) was prepared and evaluated in the same manner as in Example 1 except for using 2.0 wt. parts of Inorganic fine powder A-2 instead of Inorganic fine powder A-1.

EXAMPLE 3

A positively chargeable toner (Toner 3) was prepared and evaluated in the same manner as in Example 1 except for using 1.0 wt. part of Inorganic fine powder A-3 instead of Inorganic fine powder A-1.

EXAMPLE 4

A positively chargeable toner (Toner 4) was prepared and evaluated in the same manner as in Example 1 except for using 4.0 wt. parts of Inorganic fine powder A-4 and 0.8 wt. part of Inorganic fine powder (ii) instead of Inorganic fine powder A-1 and Inorganic fine powder (i).

EXAMPLE 5

A positively chargeable toner (Toner 5) was prepared and evaluated in the same manner as in Example 1 except for using 3.0 wt. parts of Inorganic fine powder A-5 and 0.8 wt. part of Inorganic fine powder (ii) instead of Inorganic fine powder A-1 and Inorganic fine powder (i).

EXAMPLE 6

| | |
|---|---|
| Styrene-butyl acrylate copolymer (binder resin) | 100 wt. parts |
| Magnetic iron oxide (magnetic material) | 90 wt. parts |
| Monoazo dye chromium complex (negative charge control agent) | 2 wt. parts |
| Low-molecular weight polypropylene (release agent) | 4 wt. parts |

The above ingredients were preliminarily blended within a Henschel mixer and then melt-kneaded through a twin-screw extruder set at 130° C. The melt-kneaded product was coarsely crushed by a cutter mill and then finely pulverized by a pulverizer using a jet air stream. The pulverized powder was classified by a multi-division classifier utilizing the Coanda effect to obtain toner particles. Then, 100 wt. parts of the toner particles were externally blended with 0.5 wt. part of Inorganic fine powder A-6 and 1.0 wt. part or Inorganic fine powder (iii) to obtain a negatively chargeable toner (Toner 6). Toner 6 exhibited a weight-average particle size (D4) of 6.5 μm.

Toner 6 was incorporated in a commercially available laser beam printer having an OPC photosensitive drum ("LBP-930", mfd. by Canon K.K.) and subjected to a continuous printing on 15,000 sheets under the developing conditions of a non-image part drum potential=−700 volts, an image part drum potential=−170 volts, a developing bias DC component =−500 volts, and an image potential contrast=330 volts and by using a polyurethane cleaning blade (hardness=65 deg., thickness=1.2 mm) as a cleaning member so as to provide a pressing margin of 0.9 mm. The evaluation was effected in the same manner as in Example 1 except for the number of printing sheets, and the results are also shown in Tables 3 and 4.

EXAMPLE 7

| | |
|---|---|
| Crosslinked polyester resin (binder resin) | 100 wt. parts |
| Magnetic iron oxide (magnetic material) | 90 wt. parts |
| Monoazo dye chromium complex (negative charge control agent) | 2 wt. parts |
| Low-molecular weight polypropylene (release agent) | 4 wt. parts |

The above ingredients were preliminarily blended within a Henschel mixer and then melt-kneaded through a twin-screw extruder set at 130° C. The melt-kneaded product was coarsely crushed by a cutter mill and then finely pulverized by a pulverizer using a jet air stream. The pulverized powder was classified by a multi-division classifier utilizing the Coanda effect to obtain toner particles. Then, 100 wt. parts of the toner particles were externally blended with 5.0 wt. parts of Inorganic fine powder A-7 and 1.0 wt. part or Inorganic fine powder (iv) to obtain a negatively chargeable toner (Toner 7). Toner 7 exhibited a weight-average particle size (D4) of 7.8 μm.

Toner 7 was incorporated in a commercially available copying machine having an a-Si photosensitive drum ("NP-6085", mfd. by Canon K.K.) and subjected to a copying test under developing conditions including a non-image part drum potential of 50 volts, an image part drum potential of 420 volts, a developing bias DC component of 190 volts, an image potential contrast of 230 volts and drum surface temperature=42° C., and using a cleaning system including a magnetic cleaning roller having 6 poles exerting a magnetic flux density of 750 gauss and a polyurethane rubber cleaning blade (hardness=73 deg., thickness=3 mm). The magnetic cleaning roller was rotated at a circumferential speed of 80% of that of the photosensitive drum in an identical direction while leaving a gap of 1.2 mm from the drum, and the cleaning blade was pressed against the drum so as to provide a pressing margin of 0.5 mm. The evaluation was effected in the same manner as in Example 1, and the results are also shown in Tables 3 and 4.

COMPARATIVE EXAMPLES 1, 3 and 4

Positively chargeable toners (Comparative Toners 1, 3 and 4) were prepared and evaluated in the same manner as in Example 1 except for using Inorganic fine powders a-1, a-3 and a-4, respectively, instead of Inorganic fine powder A-1. The results are also shown in Tables 3 and 4.

COMPARATIVE EXAMPLE 2

A negatively chargeable toner (Comparative Toner 2) was prepared and evaluated in the same manner as in Example 7 except for using Inorganic fine powder a-2 instead of Inorganic fine powder A-1. The results are also shown in Tables 3 and 4.

EXAMPLE 8

| | |
|---|---|
| Styrene-butyl acrylate copolymer (binder resin) | 100 wt. parts |
| Copper phthalocyanine pigment (colorant) | 3.5 wt. parts |
| Triphenylmethane lake pigment (positive charge control agent) | 2 wt. parts |
| Low-molecular weight polyethylene (release agent) | 3 wt. parts |

The above ingredients were preliminarily blended within a Henschel mixer and then melt-kneaded through a twin-screw extruder set at 120° C. The melt-kneaded product was coarsely crushed by a cutter mill and then finely pulverized by a pulverizer using a jet air stream. The pulverized powder was classified by a pneumatic classifier to obtain toner particles. Then, 100 wt. parts of the toner particles were externally blended with 1.0 wt. part of Inorganic fine powder A-1 and 1.0 wt. part or Inorganic fine powder (i) to obtain a positively chargeable toner (Toner 8). Toner 8 exhibited a weight-average particle size (D4) of 8.5 μm.

Toner 8 was incorporated in a commercially available copying machine having an OPC photosensitive drum ("FC-330", mfd. by Canon K.K.) and subjected to a continuous copying on 1000 sheets under the developing conditions of a non-image part drum potential=−150 volts, an image part drum potential=−600 volts, a developing bias DC component=−280 volts, and an image potential contrast=320 volts and by using a polyurethane cleaning blade (hardness=65 deg., thickness=1.2 mm) as a cleaning member so as to provide a pressing margin of 0.7 mm. The evaluation was effected in the same manner as in Example 1 with respect to the items except for the drum abrasion. The results are also shown in Tables 3 and 4.

TABLE 1

| | | A-type inorganic fine powder | | | | | | | | | |
|---|---|---|---|---|---|---|---|---|---|---|---|
| | Inorganic | | Component oxide content in TREO | | | | | | | | |
| Prod. EX. | fine powder | TREO (wt. %) | $CeO_2$ (wt. %) | $La_2O_3$ (wt. %) | $Pr_6O_{11}$ (wt. %) | $Nd_2O_3$ (wt. %) | U (ppm) | Th (ppm) | F (wt. %) | Dv (μm) | $S_{BET}$ ($m^2/g$) |
| 1 | A-1 | 94.1 | 56.6 | 34.4 | 5.5 | 3.3 | <0.1 | <0.1 | 8.4 | 0.82 | 3.24 |
| 2 | A-2 | 91.9 | 60.9 | 28.9 | 5.4 | 4.4 | <0.1 | <0.1 | 4.1 | 1.22 | 2.90 |
| 3 | A-3 | 89.2 | 47.2 | 42.7 | 2.2 | 7.6 | <0.1 | 0.8 | 9.6 | 3.33 | 0.65 |
| 4 | A-4 | 95.2 | 64.0 | 25.5 | 8.3 | 1.9 | 0.2 | 2.4 | 5.0 | 0.25 | 12.8 |
| 5 | A-5 | 93.2 | 54.4 | 35.9 | 7.6 | 2.8 | <0.1 | <0.1 | 8.2 | 1.75 | 1.58 |
| 6 | A-6 | 88.8 | 42.4 | 43.B | 5.2 | 9.2 | 3.1 | 45 | 3.4 | 0.58 | 7.32 |
| 7 | A-7 | 91.7 | 56.8 | 33.5 | 4.2 | 5.3 | <0.1 | <0.1 | 2.5 | 1.51 | 1.97 |
| Comp. 1 | a-1 | 91.2 | 36.5 | 52.4 | 7.2 | 3.5 | <0.1 | <0.1 | 4.5 | 1.65 | 1.85 |
| Comp. 2 | a-2 | 93.5 | 56.7 | 32.2 | 7.2 | 3.6 | <0.1 | <0.1 | 14.6 | 1.55 | 1.90 |
| Comp. 3 | a-3 | 82.6 | 44.5 | 29.5 | 8.2 | 17.6 | 55 | 1660 | 1.8 | 1.48 | 2.05 |
| Comp. 4 | a-4 | 87.7 | 85.8 | 10.5 | 1.8 | 1.7 | 26 | 1430 | 0.9 | 1.62 | 1.95 |

TREO: rare earth compound
U: uranium
Th: thorium
F: fluorine

TABLE 2

B-type & C-type inorganic fine powders

| Prod EX | In-organic fine powder | SBET before treat-ment ($m^2/g$) | Treating agent* (wt. parts) 1 | 2 | pH | SBET after treatment ($m^2/g$) |
|---|---|---|---|---|---|---|
| 1 | i | 165 | γ-APTES (3 wt. parts) | DMSO (17 wt. parts) | 8.0 | 115 |
| 2 | ii | 125 | — | AKMSO (12 wt. parts) | 7.8 | 95 |
| 3 | iii | 195 | DMDMOS (20 wt. parts) | DMSO (20 wt. parts) | 5.5 | 165 |
| 4 | iv | 280 | HMDSZ (20 wt. parts) | | 9.5 | 230 |

*γ-APTES = γ-aminopropyltriethoxysilane
DMSO = dimethylsilicone oil (50 mm2/sec)
AKMSO = aminomodified alkoxy-modified silicone oil (70 mm2/sec, amine equivalent = 830)
DMDMOS = dimethyldimethoxysilane
HMDSZ = hexamethyldisilazane

TABLE 4

Evaluation in HT/HH (30° C./80% RH) environment

| Ex. % Comp. Ex. | Inorganic fine powder A-type Add. amount (wt. parts) | | B type & C-type Add. amount (wt. parts) | | Toner D4 (μm) | Image density | Fog | Toner sticking | Image flow | Cleaner Slipping-by | Cleaner Leakage | Drum abrasion (nm) |
|---|---|---|---|---|---|---|---|---|---|---|---|---|
| Ex. 1 | A-1 | 3.0 | i | 1.0 | 7.2 | 1.40 | 0.2 | A | A | A | A | 4.5 |
| Ex. 2 | A-2 | 2.0 | i | 1.0 | 7.2 | 1.41 | 0.3 | A | A | A | A | 3.9 |
| Ex. 3 | A-3 | 1.0 | i | 1.0 | 7.2 | 1.36 | 0.7 | B | B | B | A | 2.9 |
| Ex. 4 | A-4 | 4.0 | ii | 0.8 | 7.2 | 1.35 | 0.6 | B | B | A | B | 5.6 |
| Ex. 5 | A-5 | 3.0 | ii | 0.8 | 7.2 | 1.40 | 0.4 | A | A | A | A | 4.8 |
| Ex. 6 | A-6 | 0.5 | iii | 1.0 | 6.5 | 1.38 | 0.9 | C | C | A | B | 9.0(μm) |
| Ex. 7 | A-7 | 5.0 | iv | 1.0 | 7.8 | 1.41 | 0.5 | A | A | A | A | 5.8 |
| Ex. 8 | A-1 | 1.0 | i | 1.0 | 8.5 | 1.36 | 0.7 | B | A | B | A | — |
| Comp. Ex. 1 | a-1 | 3.0 | i | 1.0 | 7.2 | 1.32 | 1.0 | C | B | C | C | 13.8 |
| Comp. Ex. 2 | a-2 | 3.0 | i | 1.0 | 7.2 | 1.29 | 1.5 | C | D | A | B | 2.2 |
| Comp. Ex. 3 | a-3 | 3.0 | i | 1.0 | 7.2 | 1.27 | 0.9 | C | C | C | B | 2.4 |
| Comp. Ex. 4 | a-4 | 3.0 | i | 1.0 | 7.2 | 1.34 | 1.5 | C | B | B | D | 12.4 |

What is claimed is:

1. A toner, comprising: toner particles each comprising a binder resin and a colorant, and inorganic fine powder A, wherein the inorganic fine powder A contains 88.0–97.0 wt. % of a rare earth compound comprising a rare earth oxide, the rare earth compound contains 40.0–65.0 wt. % of Ce (calculated as $CeO_2$), 25.0–45.0 wt. % of La (calculated as $La_2O_3$), 1.0–10.0 wt. % of Nd (calculated as $Nd_2O_3$) and 1.0–10.0 wt. % of Pr (calculated as $Pr_6O_{11}$), and the rare earth compound contains a fluorinated rare earth compound in such an amount as to provide the inorganic fine powder A with a fluorine content of 2.0–11.0 wt. %.

2. The toner according to claim 1, wherein the inorganic fine powder A has a volume-average particle size of 0.1–4.0 μm, and a BET specific surface area according to nitrogen adsorption of 0.5–15.0 $m^2/g$.

3. The toner according to claim 1, wherein the inorganic fine powder A has a volume-average particle size of 0.2–2.0 μm, and a BET specific surface area according to nitrogen adsorption of 1.0–10.0 $m^2/g$.

4. The toner according to claim 1, wherein the inorganic fine powder A contains 89.0–96.0 wt. % of the rare earth compound.

5. The toner according to claim 1, wherein the inorganic fine powder A contains 90.0–95.0 wt. % of the rare earth compound.

6. The toner according to claim 1, which toner contains 0.1–10.0 wt. % of the inorganic fine powder A.

7. The toner according to claim 1, which toner contains 0.1–7.0 wt. % of the inorganic fine powder A.

8. The toner according to claim 1, wherein the inorganic fine powder A is an inorganic fine powder obtained by converting bastnaesite into rare earth oxide and partially fluorinating the rare earth oxide with hydrofluoric acid.

9. The toner according to claim 1, wherein the inorganic fine powder A contains less than 100 ppm each of uranium and thorium.

10. The toner according to claim 1, which toner further contains inorganic fine powder B giving a dispersion at a concentration of 4 g/100 cc exhibiting a pH of at least 7.

11. The toner according to claim 1, which toner further contains inorganic fine powder C having been treated with silicone oil.

12. The toner according to claim 1, which toner is positively chargeable.

13. The toner according to claim 1, which toner has a weight-average particle size of 4–13 μm.

14. The toner according to claim 1, which toner has a weight-average particle size of 5–12 μm.

15. An image forming method, comprising:

a charging step of charging an image-bearing member, an image forming step of forming an electrostatic image on the charged image-bearing member, a developing step of developing the electrostatic image with a toner to form a toner image on the image-bearing member, a transfer step of transferring the toner image onto a recording material via or without via an intermediate transfer member, a fixing step of heat-fixing the toner image onto the recording material, and a cleaning step of cleaning a surface of the image bearing member after transfer of the toner image; wherein the toner comprises toner particles each comprising a binder resin and a colorant, and inorganic fine powder A, the inorganic fine powder A contains 88.0–97.0 wt. % of a rare earth compound comprising a rare earth oxide, the rare earth compound contains 40.0–65.0 wt. % of Ce (calculated as $CeO_2$), 25.0–45.0 wt. % of La (calculated as $La_2O_3$), 1.0–10.0 wt. % of Nd (calculated as $Nd_2O_3$) and 1.0–10.0 wt. % of Pr (calculated as $Pr_6O_{11}$), and the rare earth compound contains a fluorinated rare earth compound in such an amount as to provide the inorganic fine powder A with a fluorine content of 2.0–11.0 wt. %.

16. The image forming method according to claim 15, wherein the image-bearing member comprises an amorphous silicon photosensitive member.

17. The image forming method according to claim 16, wherein the amorphous silicon photosensitive member is charged and then exposed to form a digital latent image.

18. The image forming method according to claim 16, wherein the amorphous silicon photosensitive member is charged to a positive potential and exposed to form a digital latent image, which is developed with the toner having a positive triboelectric charge according to a reversal development mode.

19. The image forming method according to claim 15, wherein the image-bearing member is regulated to have a surface temperature of at most 45° C. during image formation.

20. The image forming method according to claim 15, wherein the image bearing member is cleaned by means of a cleaning blade, a cleaning roller or a combination of these in the cleaning step.

21. The image forming method according to claim 15, wherein the image bearing member is cleaned by means of at least a cleaning roller enclosing therein a magnetic field generating means.

22. The image forming method according to claim 15, wherein the recording material is conveyed for the transfer step by means of an elastic roller.

23. The image forming method according to claim 15, wherein the inorganic fine powder A has a volume-average particle size of 0.1–4.0 μm, and a BET specific surface area according to nitrogen adsorption of 0.5–15.0 $m^2/g$.

24. The image forming method according to claim 15, wherein the inorganic fine powder A has a volume-average particle size of 0.2–2.0 μm, and a BET specific surface area according to nitrogen adsorption of 1.0–10.0 $m^2/g$.

25. The image forming method according to claim 15, wherein the inorganic fine powder A contains 89.0–96.0 wt. % of the rare earth compound.

26. The image forming method according to claim 15, wherein the inorganic fine powder A contains 90.0–95.0 wt. % of the rare earth compound.

27. The image forming method according to claim 15, wherein the toner contains 0.1–10.0 wt. % of the inorganic fine powder A.

28. The image forming method according to claim 15, wherein the toner contains 0.1–7.0 wt. % of the inorganic fine powder A.

29. The image forming method according to claim 15, wherein the inorganic fine powder A is an inorganic fine powder obtained by converting bastnaesite into rare earth oxide and partially fluorinating the rare earth oxide with hydrofluoric acid.

30. The image forming method according to claim 15, wherein the inorganic fine powder A contains less than 100 ppm each of uranium and thorium.

31. The image forming method according to claim 15, wherein the toner further contains inorganic fine powder B giving a dispersion at a concentration of 4 g/100 cc exhibiting a pH of at least 7.

32. The image forming method according to claim 15, wherein the toner further contains inorganic fine powder C having been treated with silicone oil.

33. The image forming method according to claim 15, wherein the toner is positively chargeable.

34. The image forming method according to claim 15, wherein the toner has a weight-average particle size of 4–13 μm.

35. The image forming method according to claim 15, wherein the toner has a weight-average particle size of 5–12 μm.

* * * * *

UNITED STATES PATENT AND TRADEMARK OFFICE

CERTIFICATE OF CORRECTION

PATENT NO. : 6,156,471
DATED : December 5, 2000
INVENTOR(S) : Takakuni Kobori et al.

It is certified that error appears in the above-identified patent and that said Letters Patent is hereby corrected as shown below:

Column 1,
Line 9, "electrophoto-graphic" should read -- electrophotographic --.

Column 2,
Line 16, "a a" should read -- a --; and
Line 67, "disposed" should read -- dispose --.

Column 3,
Line 23, "either" should read -- also --.

Column 4,
Line 3, " mean s" should read -- means --.

Column 5,
Line 53, "stabilizing" should read -- stabilize --.

Column 6,
Line 28, "fluorinatingi" should read -- fluorinating --.

Column 7,
Line 53, "blade-photosensitive" should read -- blade and photosensitive --.

Column 8,
Line 29, "a totally" should read -- in total --;
Line 50, "%-NaOH" should read -- % of NaOH --.

Column 12,
Line 22, "bis(3-propylaminopropyl)- 1,1,3,3-tetramethyldisilazane," should read -- bis (3-propylaminopropyl)-1,1,3,3-tetramethyldisilazane, --;
Line 28, "aminopropyl}-1,1,3,3-tetramethyl-disiloxane," should read -- aminopropyl}-1,1,3,3-tetramethyldisiloxane, --.

Column 13,
Line 17, "o-chlooethyltrichlorosilane," should read -- o-chloroethyltrichlorosilane, --;
Line 23, "hexamethyl-disiloxane," should read -- hexamethyldisiloxane, --.

Column 14,
Line 30, "6-40 wt," should read -- 6-40 wt. --;
Line 45, "comprises:" should read -- comprise: --.

UNITED STATES PATENT AND TRADEMARK OFFICE

CERTIFICATE OF CORRECTION

PATENT NO. : 6,156,471
DATED : December 5, 2000
INVENTOR(S) : Takakuni Kobori et al.

It is certified that error appears in the above-identified patent and that said Letters Patent is hereby corrected as shown below:

Column 15,
Line 35, "speed," should read -- speed; --.

Column 16,
Line 7, "stitute" should read -- stitutes --;
Line 39, "azobisisobutylo-nitrile," should read -- azobisisobutyronitrile, --.

Column 19,
Line 3, "olefin" should read -- of olefin --;
Line 29, "component" should read -- components --.

Column 20,
Line 10, "denotes" should read -- denote --.

Column 21,
Line 3, "atoms;" should read -- atoms); --.

Column 22,
Line 38, "toner" should read -- toner may --;
Line 46, "Modant" should read -- Mordant --.

Column 23,
Line 16, "groups" should read -- groups are --.

Column 25,
Line 10, "pm-aperture." should read -- μm-aperture. --;
Line 15, "($D_4$)" should read -- (D4) --;
Line 19, " 8.00-10.08 μm" should read -- 8.00-10.08 μm; --;
Line 21, "25.40-32.00 μm:" should read -- 25.40.-32.00 μm; --;
Line 46, "atom;" should read -- atoms; --;
Line 48, "Group IV" should read -- Group V --;
Line 50, " Group V atoms, or" should read -- Group V atoms on --
Line 51, " Group VIII" should read -- Group VII --;
Line 67, "or" should read -- on --.

Column 26,
Line 2, "or" should read -- on --.

UNITED STATES PATENT AND TRADEMARK OFFICE

CERTIFICATE OF CORRECTION

PATENT NO. : 6,156,471
DATED : December 5, 2000
INVENTOR(S) : Takakuni Kobori et al.

It is certified that error appears in the above-identified patent and that said Letters Patent is hereby corrected as shown below:

Column 29,
Line 31, "Th e" should read -- The --.

Column 34,
Line 25, "or" should read -- of --;
Table 1, "43.B" should read -- 43.8 --.

Column 35,
Table 2, "SBET" (both occurrences) should read -- $S_{BET}$ --;
Line 21, "(50 mm2/sec)" should be deleted;
Line 22, " (70 mm2/sec,") should be deleted.

Column 37,
Lines 35 and 39, "image bearing" should read -- image-bearing --;

Signed and Sealed this

Eighteenth Day of December, 2001

*Attest:*

*Attesting Officer*

JAMES E. ROGAN
*Director of the United States Patent and Trademark Office*